US009814943B2

(12) United States Patent
Onuki et al.

(10) Patent No.: US 9,814,943 B2
(45) Date of Patent: Nov. 14, 2017

(54) GOLF CLUB

(71) Applicant: DUNLOP SPORTS CO. LTD., Kobe-shi, Hyogo (JP)

(72) Inventors: Masahide Onuki, Kobe (JP); Yuki Motokawa, Kobe (JP); Naruhiro Mizutani, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/359,268

(22) Filed: Nov. 22, 2016

(65) Prior Publication Data

US 2017/0157471 A1 Jun. 8, 2017

(30) Foreign Application Priority Data

Dec. 4, 2015 (JP) ..... 2015-237363

(51) Int. Cl.
*A63B 53/02* (2015.01)
*A63B 53/04* (2015.01)

(52) U.S. Cl.
CPC ..... *A63B 53/02* (2013.01); *A63B 53/0466* (2013.01)

(58) Field of Classification Search
CPC ..... A63B 53/02
USPC ..... 473/305–310
See application file for complete search history.

(56) References Cited

U.S. PATENT DOCUMENTS 1,550,647 A * 8/1925 Mattern ..... A63B 53/02 473/310
1,623,523 A * 4/1927 Bourke ..... A63B 53/02 473/307
1,792,034 A * 2/1931 Reach ..... A63B 53/02 473/310
1,844,812 A * 2/1932 Thorpe ..... A63B 53/02 473/308
1,895,417 A * 1/1933 Lard ..... A63B 53/02 473/310
2,050,801 A * 8/1936 Lard ..... A63B 53/02 473/310
4,253,666 A * 3/1981 Murphy ..... A63B 53/02 473/288
4,597,577 A * 7/1986 Lamanna ..... A63B 53/02 473/201

(Continued)

FOREIGN PATENT DOCUMENTS

AU WO 8704634 A1 * 8/1987 ..... A63B 53/02
JP 04015066 A * 1/1992

(Continued)

*Primary Examiner* — Alvin Hunter
(74) *Attorney, Agent, or Firm* — Birch, Stewart, Kolasch & Birch, LLP

(57) ABSTRACT

A golf club 100 includes a head 200 having a hosel part 202, a shaft 300, and an engaging part 600 disposed at a tip part of the shaft 300. The engaging part 600 includes a sleeve 400 which has an oppositely tapered shape and is fixed to the tip part of the shaft 300. The hosel part 202 includes a hosel hole 204, and a hosel slit 206 which is provided on a side of the hosel hole 204 and enables the shaft 300 to pass through the hosel slit 206. The hosel hole 204 has an oppositely tapered hole having a shape corresponding to a shape of an outer surface of the engaging part 600. The engaging part 600 is fitted into the oppositely tapered hole.

9 Claims, 22 Drawing Sheets

(56) References Cited

U.S. PATENT DOCUMENTS

| | | | | | |
|---|---|---|---|---|---|
| 5,324,033 | A * | 6/1994 | Fenton, Jr. | A63B 53/02 | 473/305 |
| 5,722,901 | A * | 3/1998 | Barron | A63B 53/02 | 473/305 |
| 6,270,425 | B1 * | 8/2001 | Dyer | A63B 53/02 | 473/307 |
| 6,547,673 | B2 * | 4/2003 | Roark | A63B 53/02 | 473/239 |
| 6,769,994 | B2 * | 8/2004 | Boone | A63B 53/02 | 473/245 |
| 7,438,645 | B2 * | 10/2008 | Hsu | A63B 53/02 | 473/246 |
| 7,922,599 | B2 * | 4/2011 | Yamamoto | A63B 53/02 | 473/288 |
| 7,980,959 | B2 * | 7/2011 | Morris | A63B 53/02 | 473/288 |
| 7,997,997 | B2 * | 8/2011 | Bennett | A63B 53/02 | 473/288 |
| 8,133,130 | B2 * | 3/2012 | Morris | A63B 53/02 | 473/288 |
| 8,523,701 | B2 * | 9/2013 | Knutson | A63B 53/02 | 473/246 |
| 8,545,345 | B2 * | 10/2013 | Lo | A63B 53/02 | 473/306 |
| 2010/0197423 | A1 | 8/2010 | Thomas et al. | | |
| 2013/0017901 | A1 | 1/2013 | Sargent et al. | | |

FOREIGN PATENT DOCUMENTS

| | | | | | |
|---|---|---|---|---|---|
| JP | 2006334142 | A * | 12/2006 | | |
| JP | 2011062523 | A * | 3/2011 | | |
| NZ | WO 2009035345 | A1 * | 3/2009 | A63B 53/02 | |
| WO | 2004098727 | A1 * | 11/2004 | A63B 53/02 | |

* cited by examiner

GOLF CLUB

The present application claims priority on Patent Application No. 2015-237363 filed in JAPAN on Dec. 4, 2015, the entire contents of which are hereby incorporated by reference.

BACKGROUND OF THE INVENTION

Field of the Invention

The present invention relates to a golf club.

Description of the Related Art

A golf club including a head and a shaft detachably attached to the head is proposed.

Each of US2013/0017901 and U.S. Pat. No. 7,980,959 discloses a golf club including a head and a shaft detachably attached to the head.

Japanese Patent No. 5645936 (US2010/0197423) discloses a golf club having a shaft adapter and a head adapter.

SUMMARY OF THE INVENTION

The present embodiments provide a golf club in which a shaft can be detachably attached to a head and which can solve a problem caused by fixation using a screw.

In one aspect, a golf club includes a head having a hosel part, a shaft, and an engaging part disposed at a tip part of the shaft. The engaging part includes a sleeve which has an oppositely tapered shape and is fixed to the tip part of the shaft . The hosel part includes a hosel hole, and a hosel slit which is provided on a side of the hosel hole and enables the shaft to pass through the hosel slit. The hosel hole has an oppositely tapered hole having a shape corresponding to a shape of an outer surface of the engaging part. The engaging part is fitted into the oppositely tapered hole.

In another aspect, an axis line of the shaft is inclined with respect to, or parallel and eccentric to an axis line of an outer surface of the sleeve.

In another aspect, the engaging part includes the sleeve and at least one spacer externally fitted to the sleeve.

In another aspect, an axis line of an inner surface of the spacer is inclined with respect to, or parallel and eccentric to an axis line of an outer surface of the spacer.

In another aspect, the outer surface of the engaging part is a pyramid surface.

In another aspect, the pyramid surface is a four-sided pyramid surface, a six-sided pyramid surface, or an eight-sided pyramid surface.

In another aspect, the head further includes a coming-off preventing mechanism for regulating a movement of the engaging part in an engaging releasing direction.

BRIEF DESCRIPTION OF THE DRAWINGS

FIG. 5 is a sectional view of a hosel part;

FIG. 10 is a sectional view of a hosel part;

FIG. 13(*b*) and FIG. 13(*c*) are sectional views showing modification examples of a position adjustment structure;

FIG. 22 is a sectional view of a hosel part as with FIG. 10.

DESCRIPTION OF THE PREFERRED EMBODIMENTS

In the conventional techniques, the sleeve is fixed by using a screw. The screw may be connected to the sleeve from a lower side (sole side), or may be connected to the sleeve from an upper side (grip side).

A large centrifugal force acts on a head during swinging. In addition, a strong impact shock force caused by hitting acts on the head. There is required a screw having sufficient strength so that the screw can endure the centrifugal force and the impact shock force. A screw having sufficient strength has a large mass. The mass of the screw hinders the weight saving of the head. The mass of the screw reduces the degree of freedom of the weight distribution of the head.

Two adapters are used in the invention of Japanese Patent No. 5645936, and the degree of freedom of the inclining direction of the shaft axis is high. Meanwhile, the position and the angle of the screw fixing the shaft adapter are changed with change in the direction of the shaft axis. When change in the inclining direction of the shaft axis is large, changes in the position and the direction of the screw are also large. When the changes in the position and the angle of the screw are large, a surface on which a head part of the screw abuts cannot follow the changes in the position and the angle of the screw. For this reason, coaxial properties between the screw and a sleeve are lost, and deformation in which the screw or the sleeve is bent is imposed. The constitution may reduce the strength and the endurance of a shaft fixing structure. Due to the problem, the position and the angle of the screw are limited. That is, the adjustment ranges of a loft angle and a lie angle are restrained.

Hereinafter, some aspects will be described in detail according to the preferred embodiments with appropriate references to the accompanying drawings.

Unless otherwise described, "a circumferential direction" in the present application means a circumferential direction of a shaft. Unless otherwise described, "an axial direction" in the present application means an axial direction of the shaft. Unless otherwise described, "an axial perpendicular direction" in the present application means a direction orthogonally crossing the axial direction of the shaft. Unless otherwise described, a section in the present application means a section along a plane perpendicular to an axis line of the shaft. Unless otherwise described, a grip side in the axial direction of the shaft is defined as an upper side, and a sole side in the axial direction of the shaft is defined as a lower side.

Figure 1:
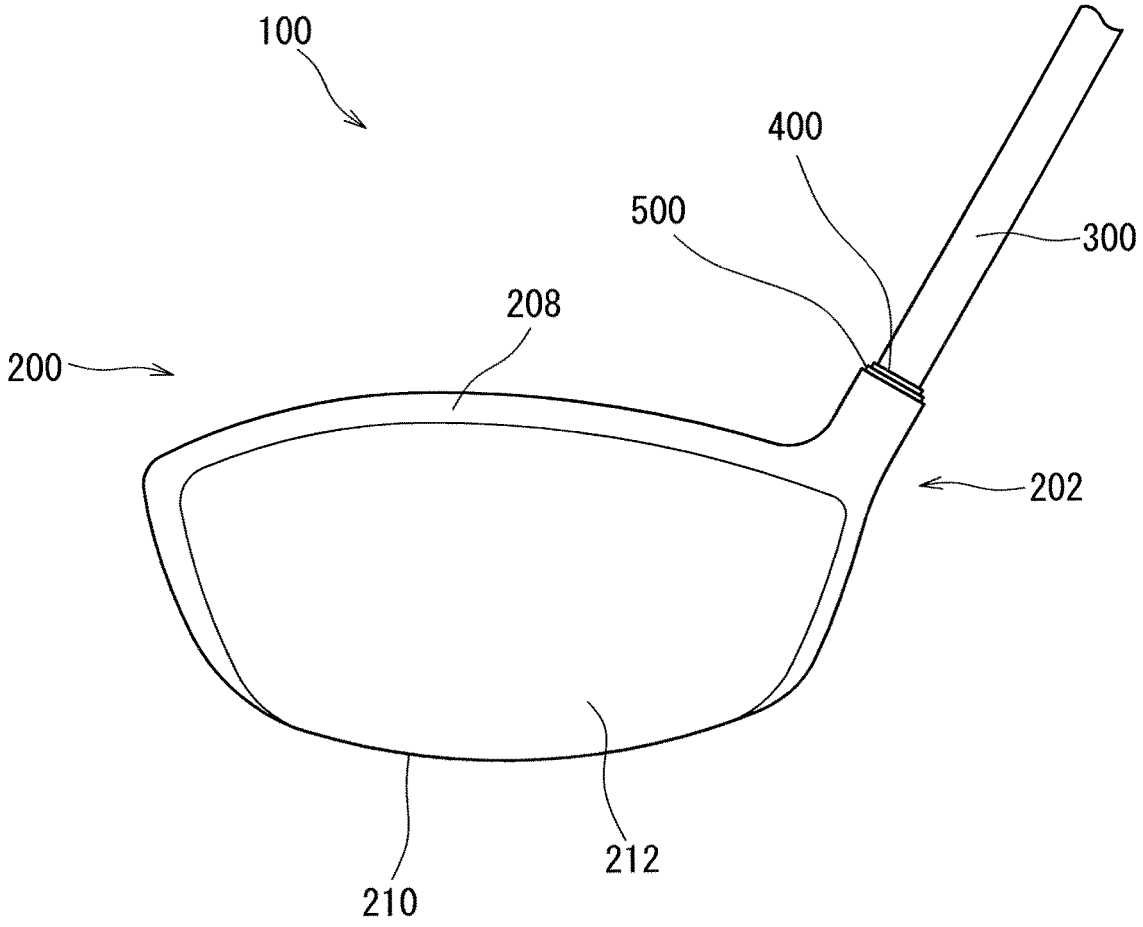
FIG. 1 is a front view of a golf club according to a first embodiment.
Figure 2:
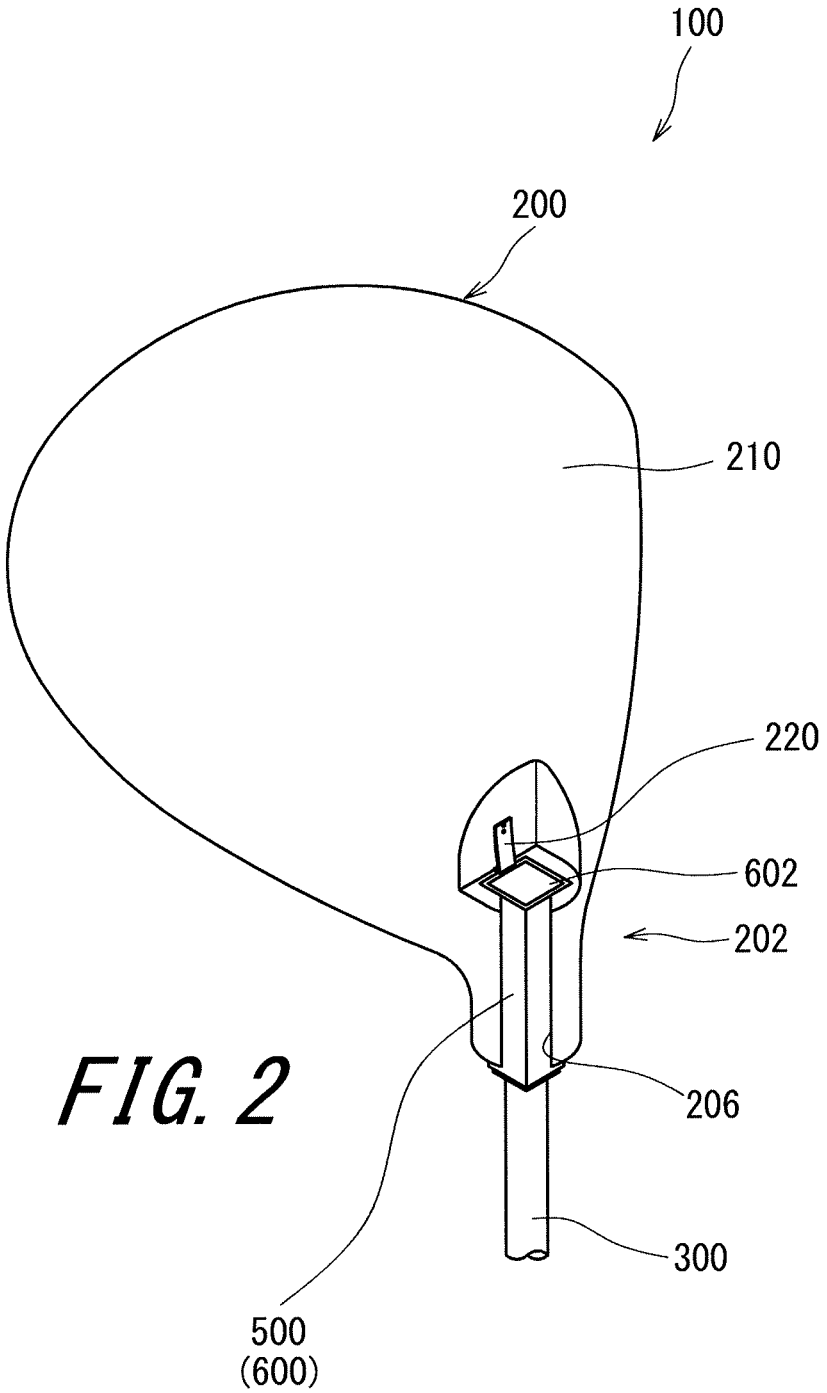
FIG. 2 is a perspective view of the golf club of FIG. 1 as viewed from a sole side.
Figure 3:
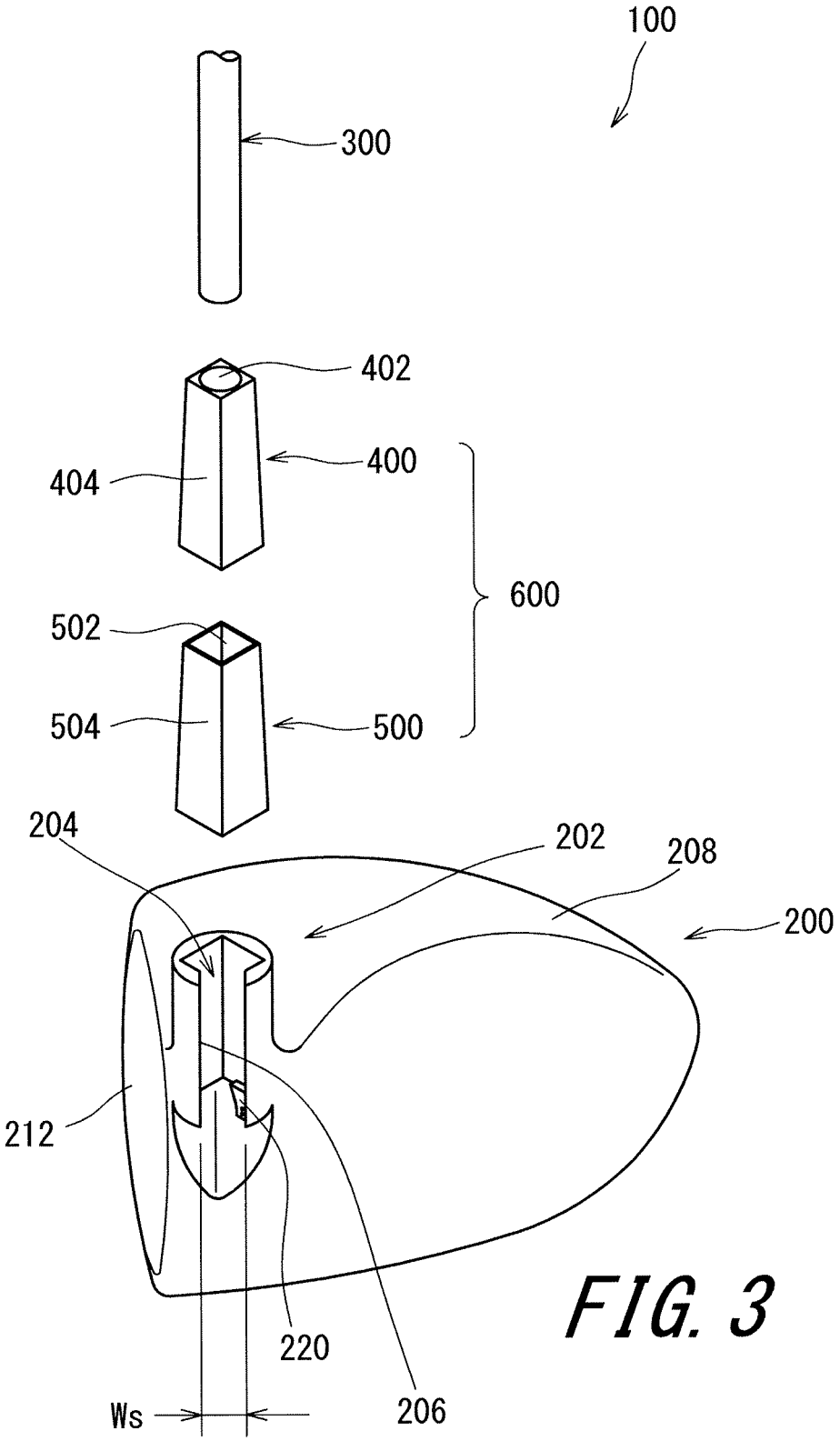
FIG. 3 is an exploded perspective view of the golf club of FIG. 1.

FIG. 1 shows a golf club 100 which is a first embodiment. FIG. 1 shows only the vicinity of a head of the golf club 100. FIG. 2 is a perspective view of the golf club 100 as viewed from a sole side. FIG. 3 is an exploded perspective view of the golf club 100.

The golf club 100 has a head 200, a shaft 300, a sleeve 400, a spacer 500, and a grip (not shown). The sleeve 400 and the spacer 500 constitute an engaging part 600. The engaging part 600 is disposed at a tip part of the shaft 300. An outer surface of the engaging part 600 is formed by the spacer 500.

The type of the head 200 is not limited. The head 200 of the present embodiment is a wood type head. The head 200 may be a hybrid type head, an iron type head, and a putter head or the like. The wood type head may be a driver head, or may be a head of a fairway wood.

The shaft 300 is not limited, and for example, a carbon shaft and a steel shaft may be used.

Although not shown, the diameter of the shaft 300 is changed depending on an axial direction position. The diameter of the shaft 300 is larger as going to the grip side. The spacer 500 is fixed to the tip part of the shaft 300. The tip part of the shaft 300 is a thinnest portion in the shaft 300.

In the present embodiment, the number of the spacers 500 is 1. As described later, the spacer 500 may not be present. As described later, the number of the spacers 500 may be 2. As described later, the number of the spacers 500 may be equal to or greater than 3. When the spacer is not present, the engaging part is constituted by only the sleeve.

The head 200 has a hosel part 202. The hosel part 202 has a hosel hole 204. The hosel hole 204 constitutes an oppositely tapered hole. The shape of the oppositely tapered hole 204 corresponds to the shape of an outer surface of the engaging part 600. In other words, the shape of the oppositely tapered hole 204 corresponds to the shape of an outer surface of the spacer 500. In the engagement state, the outer surface of the engaging part 600 (the outer surface of the spacer 500) is brought into surface-contact with the hosel hole 204. The outer surface of the engaging part 600 has a plurality of (four) planes, and all the planes are brought into surface-contact with the hosel hole 204.

The hosel part 202 has a hosel slit 206. The hosel slit 206 is provided on a side of the hosel part 202. The hosel slit 206 is an opening formed between the inside of the hosel hole 204 and the outside of the head. The hosel slit 206 is opened to an axial direction upper side, and is also opened to an axial direction lower side. The hosel slit 206 is provided on the heel side of the hosel part 202. By the hosel slit 206, a part of the oppositely tapered hole 204 is lacked.

A width Ws of the hosel slit 206 is shown in FIG. 3. The width Ws is greater than the diameter of the shaft 300. The width Ws is at least greater than the diameter of the thinnest portion of the shaft 300. For this reason, the hosel slit 206 enables the shaft 300 to pass through the hosel slit 206. The hosel slit 206 enables the shaft 300 moving in an axial orthogonal direction to pass through the hosel slit 206. The axial orthogonal direction is a direction orthogonal to the axis line of the shaft 300.

By the hosel slit 206, a part of the hosel hole 204 in the circumferential direction is lacked. From the viewpoint of improving the holding properties of the engaging part 600, the width Ws is preferably smaller. For example, it is just required that the width Ws is greater than a thinnest portion of an exposed part of the shaft 300 (for example, a portion adjacent to the engaging part 600). The exposed part means a portion to which the sleeve and the grip are not attached and which is exposed to the outside. Needless to say, the width Ws is set so that the engaging part 600 cannot pass through the hosel slit 206. The engaging part 600 cannot pass through the hosel slit 206.

As with a usual head, the head 200 has a crown 208, a sole 210, and a face 212 (see FIGS. 1 to 3).

As shown in FIG. 3, the sleeve 400 has an inner surface 402 and an outer surface 404. The inner surface 402 forms a shaft hole. The sectional shape of the inner surface 402 is a circle. The shape of the inner surface 402 corresponds to an outer surface of the shaft 300. The inner surface 402 is fixed to the tip part of the shaft 300. That is, the sleeve 400 is fixed to the tip part of the shaft 300. An adhesive is used for the fixation.

The outer surface 404 is a pyramid surface. The outer surface 404 is a four-sided pyramid surface. The sectional shape of the outer surface 404 is a non-circle. The sectional shape of the outer surface 404 is a polygon (regular polygon). The sectional shape of the outer surface 404 is a tetragon. The sectional shape of the outer surface 404 is a square. The area of a figure including a sectional line of the outer surface 404 as an outer edge is larger as approaching a lower side (sole side). In other words, the area of sectional view of the outer surface 404 is gradually increased as going to the tip side of the shaft. That is, the sleeve 400 is oppositely tapered-shaped.

As shown in FIG. 3, the spacer 500 has an inner surface 502 and an outer surface 504. The inner surface 502 forms a sleeve hole. The sectional shape of the inner surface 502 corresponds to the sectional shape of the outer surface 404 of the sleeve 400. The outer surface 404 of the sleeve 400 is fitted into the inner surface 502. In other words, the sleeve 400 is internally fitted into the spacer 500. The spacer 500 is not bonded to the sleeve 400. The spacer 500 is merely brought into contact with the sleeve 400.

The shape of the inner surface 502 corresponds to the outer surface 404 of the sleeve 400. The inner surface 502 is a pyramid surface. The inner surface 502 is a four-sided pyramid surface. The sectional shape of the inner surface 502 is a non-circle. The sectional shape of the inner surface 502 is a polygon (regular polygon). The sectional shape of the inner surface 502 is a tetragon. The sectional shape of the inner surface 502 is a square. The area of a figure including a sectional line of the inner surface 502 as an outer edge is larger as approaching a lower side (sole side). In other words, the area of sectional view of the inner surface 502 is gradually increased as going to the tip side of the shaft.

The shape of the outer surface 504 (the outer surface of the engaging part 600) corresponds to the shape of the oppositely tapered hole 204. The outer surface 504 is a pyramid surface. The outer surface 504 is a four-sided pyramid surface. The sectional shape of the outer surface 504 is a non-circle. The sectional shape of the outer surface 504 is a polygon (regular polygon). The sectional shape of the outer surface 504 is a tetragon. The sectional shape of the outer surface 504 is a square. The area of a figure including a sectional line of the outer surface 504 as an outer edge is larger as approaching a lower side (sole side). In other words, the area of sectional view of the outer surface 504 is gradually increased as going to the tip side of the shaft. That is, the spacer 500 is oppositely tapered-shaped. The sleeve 400 and the spacer 500 constitute the engaging part 600.

Figure 4:
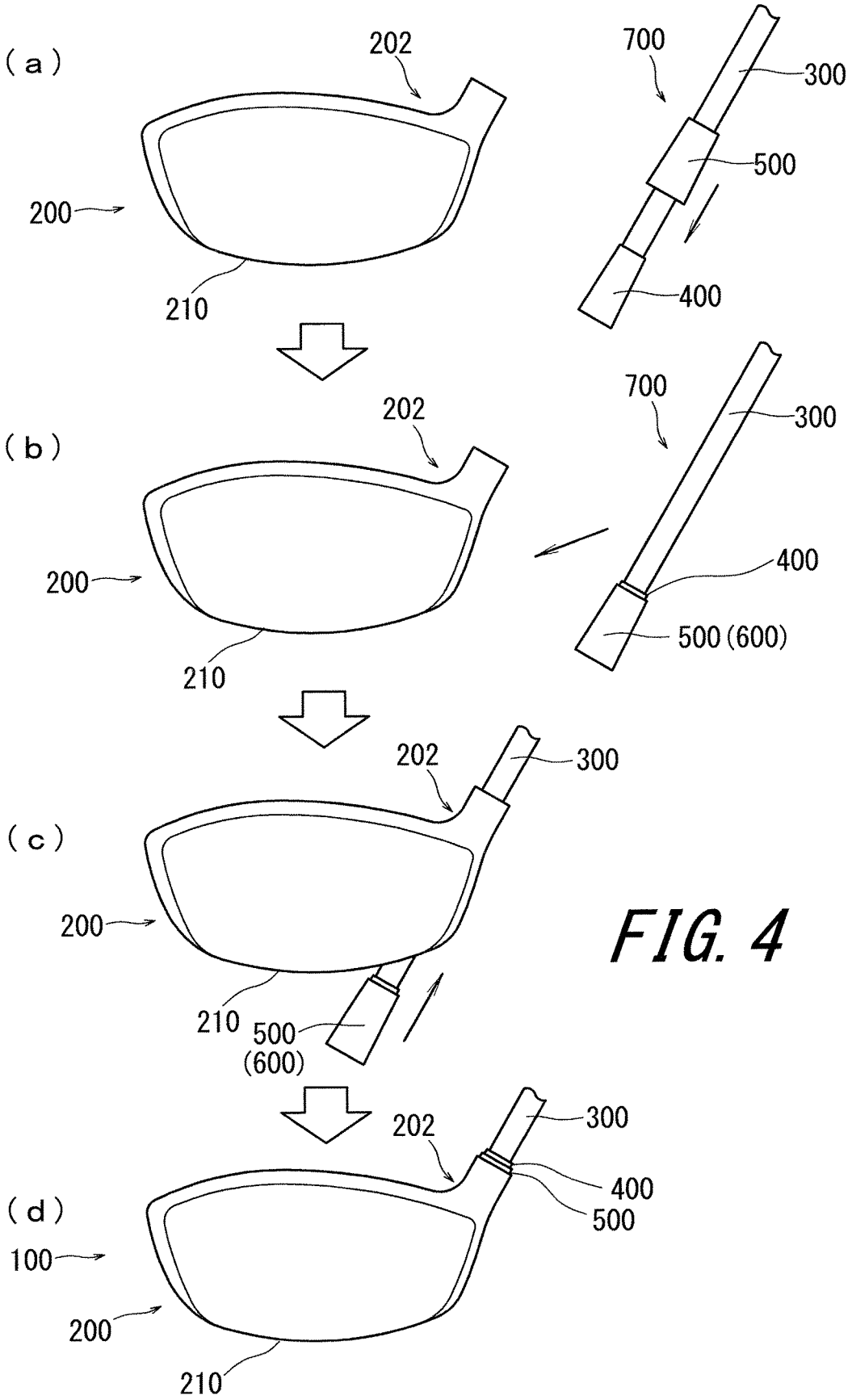
FIG. 4 is an assembling process view of the golf club of FIG. 1.

FIG. 4 shows a procedure of mounting the shaft 300 of the golf club 100 to the head 200.

When the shaft 300 is mounted, a shaft assembly 700 is first prepared (FIG. 4(*a*); first step). The shaft assembly 700 has a shaft 300, a sleeve 400, and a spacer 500. After the shaft 300 is inserted into the spacer 500, the sleeve 400 is fixed to a tip part of the shaft 300, to obtain the shaft assembly 700. In the shaft assembly 700, the sleeve 400 is fixed to the shaft 300, but the spacer 500 is not fixed to the shaft 300.

The spacer 500 can move in an axial direction in a state where the shaft 300 is inserted into the spacer 500 (see FIG. 4(*a*)). However, the spacer 500 does not come off from the shaft 300 under the presence of the sleeve 400.

Next, in the shaft assembly 700, the spacer 500 is moved until the spacer 500 abuts on an outer surface of the sleeve 400 (FIG. 4(*b*); second step). That is, the spacer 500 is moved to the forefront side of the shaft assembly 700. By the movement, the spacer 500 is engaged with the sleeve 400 to complete an engaging part 600.

Next, the shaft 300 is made to pass through the hosel slit 206, and the shaft 300 is moved into an oppositely tapered hole 204 (FIG. 4(*c*); third step). As a result of the movement of the shaft 300, the engaging part 600 moves to the sole 210 side of the head 200.

Finally, the shaft 300 (shaft assembly 700) is moved to a grip side along the axial direction, and the engaging part 600 is fitted into the oppositely tapered hole 204 (FIG. 4(*d*); fourth step). The mounting of the shaft 300 to the head 200 is achieved by the fitting. In other words, an engagement state is achieved by the fitting. The engagement state is a state where the golf club 100 can be used. In the engagement state, all oppositely tapered fittings are achieved.

Thus, the shaft 300 (shaft assembly 700) is easily attached to the head 200. In addition, the shaft 300 (shaft assembly 700) is also easily detached from the head 200 according to a procedure opposite to the above-mentioned second to fourth steps. In the golf club 100, the shaft 300 is detachably attached to the head 200.

Figure 5:
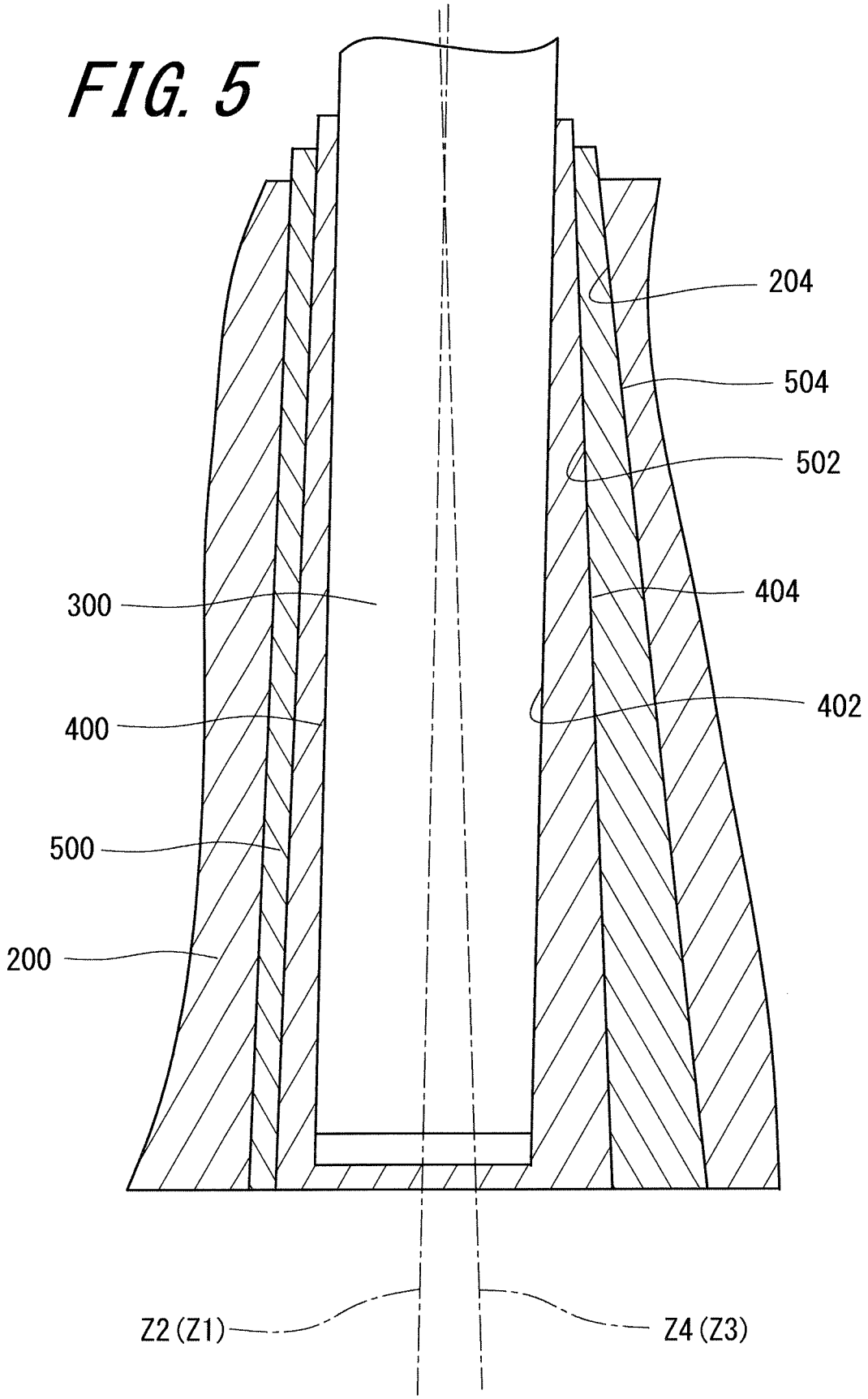
FIG. 5 is a sectional view of the golf club of FIG. 1.

FIG. 5 is a sectional view of the golf club 100 along an axial direction. FIG. 5 is an enlarged sectional view of the vicinity of the tip part of the shaft 300. In the present embodiment, an axis line Z1 of the inner surface 402 of the sleeve 400 is inclined with respect to an axis line (not shown) of the outer surface 404 of the sleeve 400. In other words, an axis line Z2 of the shaft 300 is inclined with respect to an axis line (abbreviated in the figure) of the outer surface 404 of the sleeve 400. An axis line (abbreviated in the figure) of the inner surface 502 of the spacer 500 is inclined with respect to an axis line Z3 of the outer surface 504 of the spacer 500. In other words, an axis line (abbreviated in the figure) of the inner surface 502 of the spacer 500 is inclined with respect to an axis line Z4 of the oppositely tapered hole 204 of the head 200. As a result, the axis line Z2 of the shaft 300 is inclined with respect to the axis line Z4 of the oppositely tapered hole 204 of the head 200.

Figure 6:
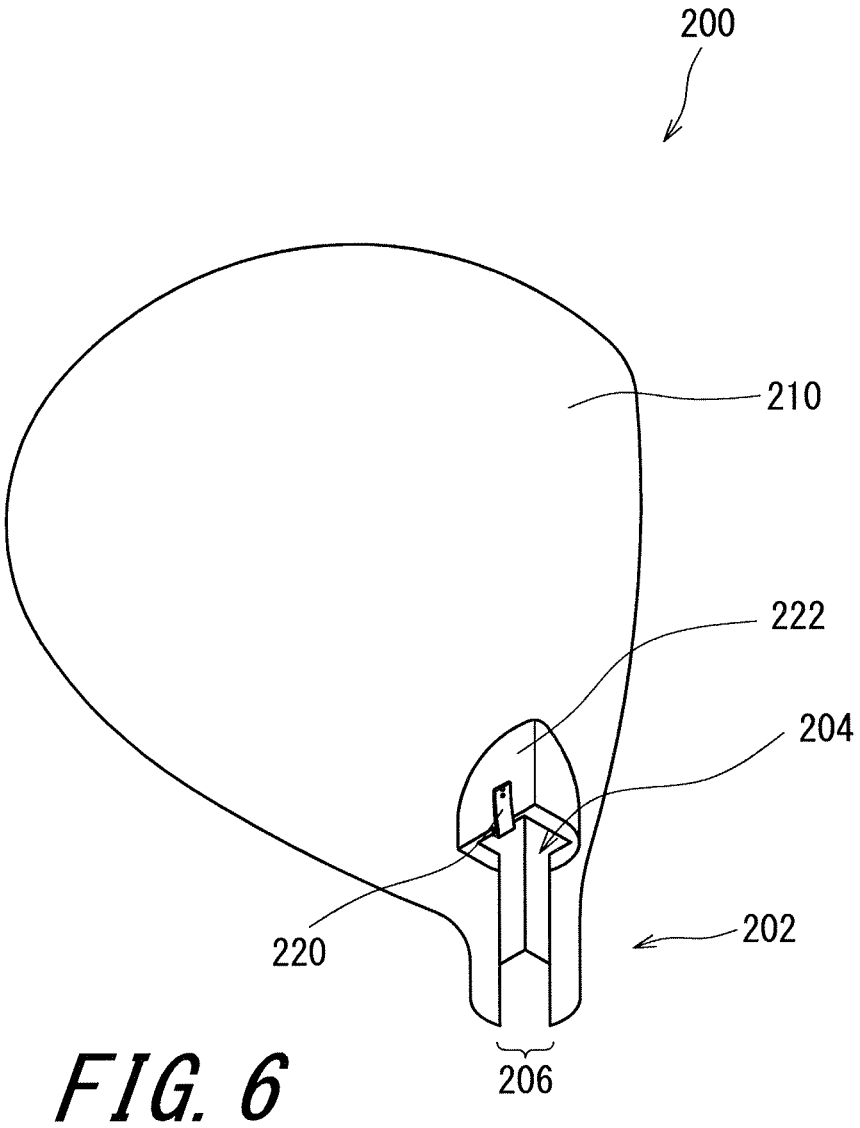
FIG. 6 is a perspective view of a head according to the first embodiment.

FIG. 6 is a perspective view of the head 200 as viewed from a sole side. The head 200 has a coming-off preventing mechanism 220. The coming-off preventing mechanism 220 is provided on an installation surface 222. The coming-off preventing mechanism 220 regulates the movement of the engaging part 600 in an engaging releasing direction.

Figure 7:
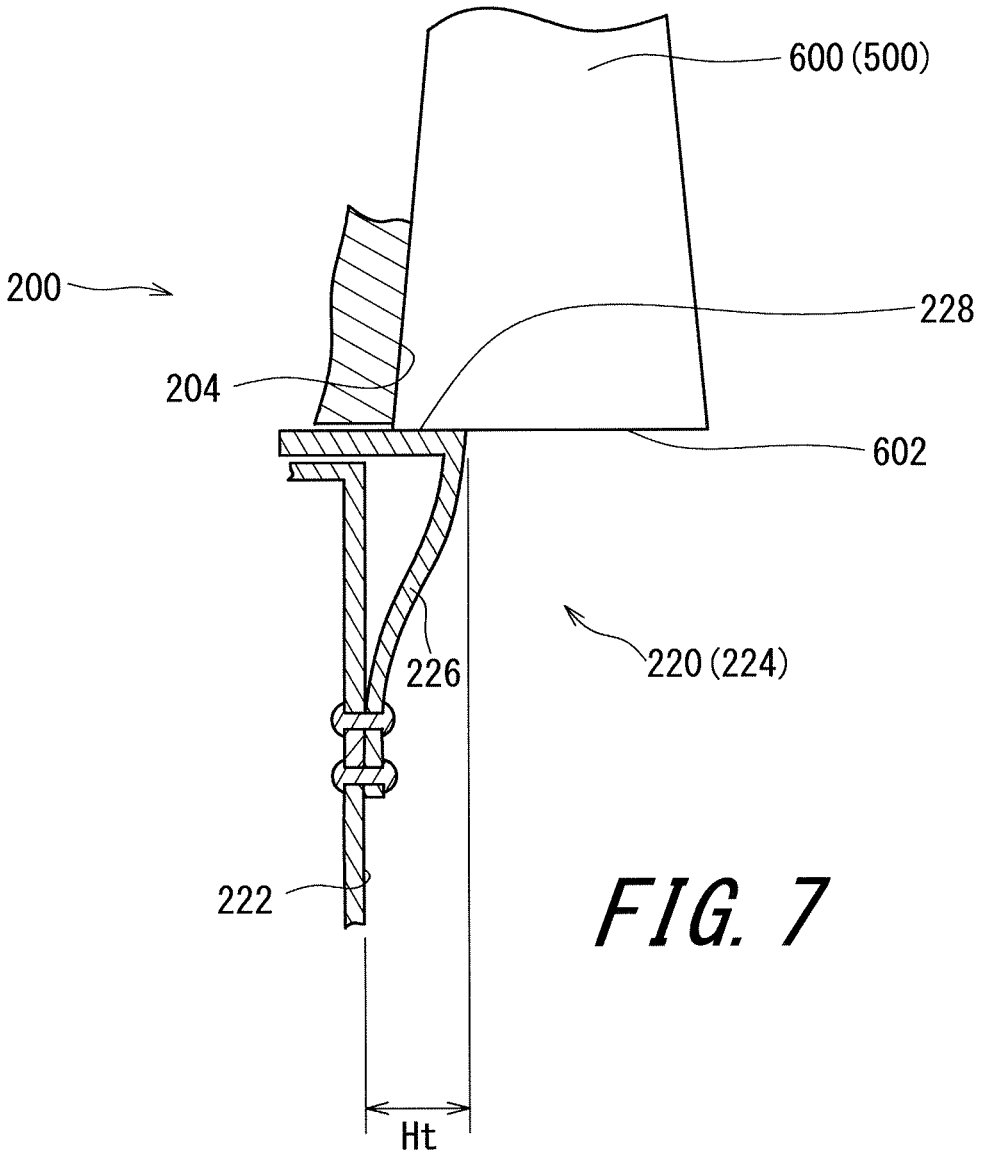
FIG. 7 is a sectional view of the vicinity of a coming-off preventing mechanism.

FIG. 7 is a sectional view of the vicinity of the coming-off preventing mechanism 220. Between FIG. 6 and FIG. 7, upper and lower sides are reversed.

The coming-off preventing mechanism 220 has an elastic protruded part 224 biased in a protrusion direction in a state where the elastic protruded part 224 can be protruded and retreated. In the present embodiment, the elastic protruded part 224 is a leaf spring 226. FIG. 7 is a sectional view of the coming-off preventing mechanism 220 in a natural state where an external force does not act. In the natural state, the leaf spring 226 is constituted so that a protrusion height Ht from the installation surface 222 is larger as approaching the oppositely tapered hole 204. In the natural state, the coming-off preventing mechanism 220 has an abutting surface 228 abutting on an end face (lower end face) 602 of the engaging part 600 fitted into the oppositely tapered hole 204. When the abutting surface 228 abuts on the end face 602, the movement of the engaging part 600 in the engaging releasing direction is regulated.

When the leaf spring 226 is pressed, the leaf spring 226 is retreated so that the protrusion height Ht is decreased. When the leaf spring 226 is retreated, the abutting surface 228 is accommodated in the head 200, which brings about a state where the abutting surface 228 cannot abut on the end face 602. In this state, the engaging part 600 can be moved in the engaging releasing direction. Therefore, the shaft assembly 700 can be detached from the head 200.

In the third step of the above-mentioned first to fourth steps, the engaging part 600 moves toward the oppositely tapered hole 204 while pressing the leaf spring 226. When the engaging part 600 reaches a position where the engaging part 600 abuts on (is engaged with) the oppositely tapered hole 204, the pressing to the leaf spring 226 provided by the engaging part 600 is eliminated, which provides the protrusion of the leaf spring 226. As a result, the abutting surface 228 abuts on the end face 602, and the coming-off preventing mechanism 220 exhibits the function.

When the function of the coming-off preventing mechanism 220 is released, the leaf spring 226 is pressed by an external force, which releases abutment between the abutting surface 228 and the end face 602. The external force is applied by human fingers, for example.

In the present application, an engaging releasing direction and an engaging direction are defined. The engaging releasing direction in the present application is a direction along the axial direction, and means a direction where the engaging part 600 moves to a sole side with respect to the oppositely tapered hole 204. In other words, the engaging releasing direction means a direction where the oppositely tapered hole 204 moves to a grip side with respect to the engaging part 600. If the engaging part 600 moves in the engaging releasing direction, the engaging part 600 comes out from the oppositely tapered hole 204. Meanwhile, the engaging direction in the present application is a direction along the axial direction, and means a direction where the engaging part 600 moves to a grip side with respect to the oppositely tapered hole 204. In other words, the engaging direction means a direction where the oppositely tapered hole 204 moves to a sole side with respect to the engaging part 600.

In the golf club 100 in the engagement state, oppositely tapered fitting is formed between the engaging part 600 and the oppositely tapered hole 204. A force in the engaging direction cannot release the oppositely tapered fitting, and increases the contact pressure of the oppositely tapered fitting conversely. The force in the engaging direction further ensures engaging between the engaging part 600 and the oppositely tapered hole 204.

The force in the engaging direction increases contact pressure between the sleeve 400 and the spacer 500. The force in the engaging direction further ensures engaging between the sleeve 400 and the spacer 500.

A large force acting on the head 200 of the golf club 100 is a centrifugal force during swinging, and an impact shock force at impact. Among these, the centrifugal force is the above-mentioned force in the engaging direction. Due to a loft angle of the head 200, a component force of the impact shock force in the axial direction is also the force in the engaging direction. Therefore, the centrifugal force and the impact shock force cannot release the engaging between the engaging part 600 and the oppositely tapered hole 204, and further ensures the engaging conversely. Since the engaging part 600 and the oppositely tapered hole 204 have a non-circular sectional shape, relative rotation between the engaging part 600 and the oppositely tapered hole 204 does not occur. As a result, although the engaging part 600 and the oppositely tapered hole 204 are not fixed by an adhesive or the like, retention and anti-rotation required as a golf club are achieved. The structure of the oppositely tapered fitting can achieve both a fixing force and attaching/detaching easiness.

Meanwhile, in situations other than swinging, the force in the engaging releasing direction may act on the golf club 100. Examples of the situations include a state where the golf club 100 is inserted into a golf bag. In this state, the golf club 100 is stood with the head 200 up. In this case, the gravity acting on the head 200 acts as the force in the engaging releasing direction. Even if the force in the engaging releasing direction acts under the presence of the coming-off preventing mechanism 220, the head 200 does not come off.

The force in the engaging releasing direction is smaller than the force in the engaging direction caused by the centrifugal force and the impact shock force or the like. Therefore, a large force does not act on the coming-off preventing mechanism 220. The coming-off preventing mechanism 220 may be a simple mechanism.

Figure 8:
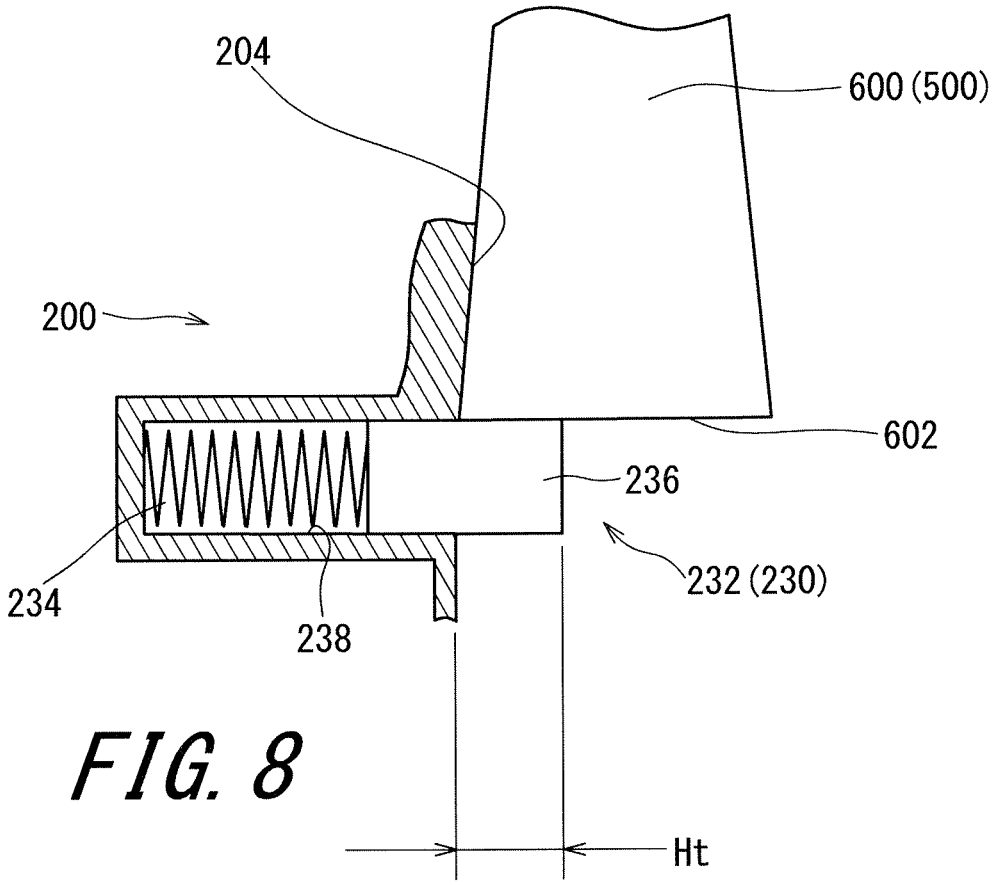
FIG. 8 is a sectional view of another coming-off preventing mechanism.

FIG. 8 is a sectional view of a coming-off preventing mechanism 230 according to modification example. As with the coming-off preventing mechanism 220, the coming-off preventing mechanism 230 has an elastic protruded part 232 biased in a protrusion direction in a state where the elastic protruded part 232 can be protruded and retreated. The elastic protruded part 232 has a compression spring 234, a slide member 236, and a slide hole 238. As the slide member 236, for example, a cylindrical member is used. As the slide hole 238, for example, a circular hole is used.

The compression spring 234 biases the slide member 236 in the protrusion direction. In a natural state where an external force does not act, the slide member 236 is at a position where the slide member 236 abuts on an end face 602. FIG. 8 shows this natural state. If the slide member 236 is pressed, the slide member 236 is retreated so that a protrusion height Ht is decreased. When the slide member 236 is retreated, engaging between the slide member 236 and the end face 602 is released. Thus, the function of the coming-off preventing mechanism 230 is the same as the function of the above-mentioned coming-off preventing mechanism 220.

Another examples of the coming-off preventing mechanism include an attaching/detaching member to be detachably attached. The attaching/detaching member is attached to a position where the attaching/detaching member abuts on an end face 602 in a golf club 100 in an engagement state. When the head 200 is detached, the attaching/detaching member is detached. Examples of an attaching/detaching mechanism including such an attaching/detaching member include an attaching/detaching mechanism described in Japanese Patent Application Laid-Open No. 2013-123439. A weight body in the gazette may be applied to the attaching/detaching member. For example, there may be adopted a constitution in which an attaching/detaching member in amounting state (engaging position) is protruded from a head body, and the protruded portion abuts on the end face 602.

Figure 9:
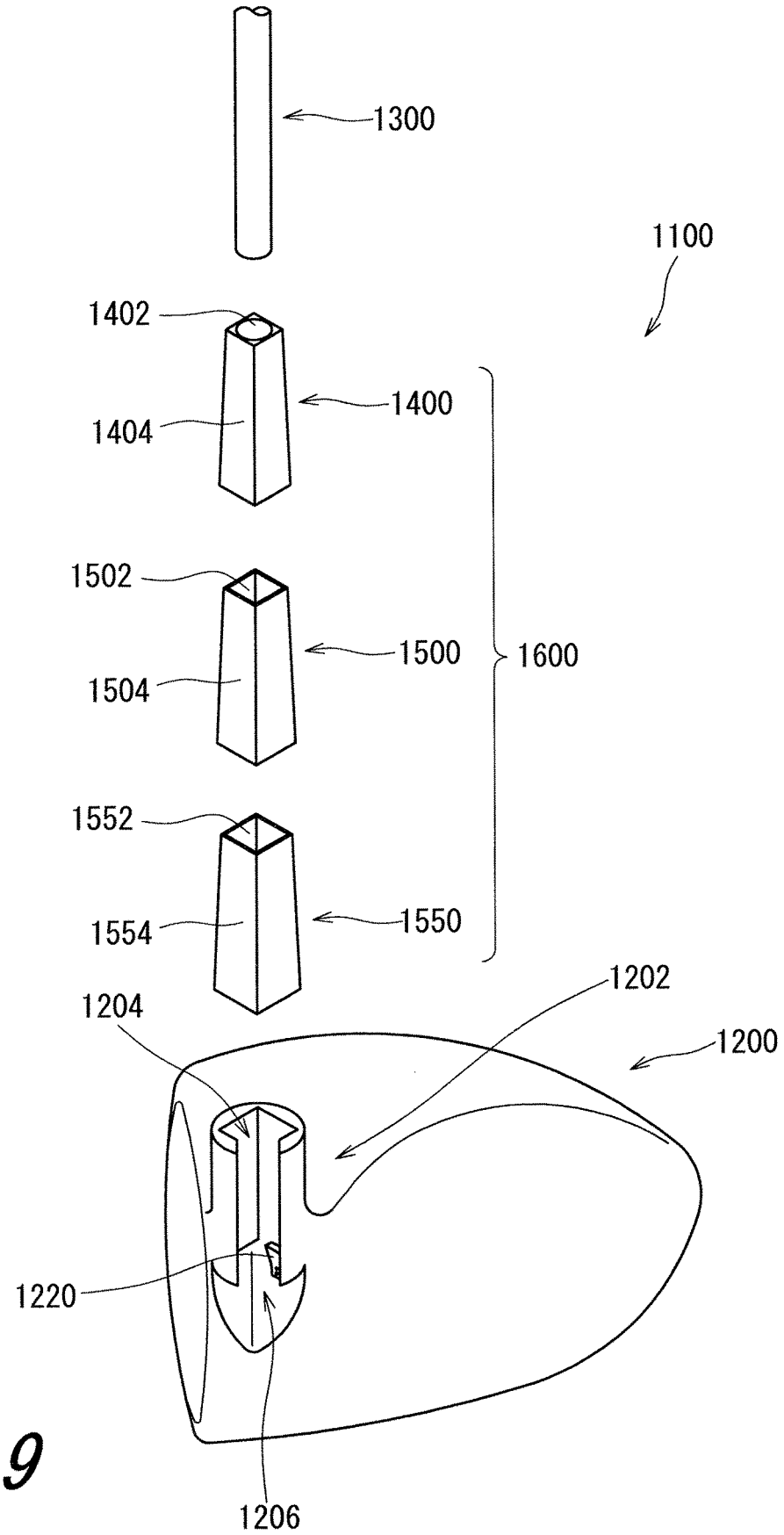
FIG. 9 is an exploded perspective view of a golf club according to a second embodiment.
Figure 10:
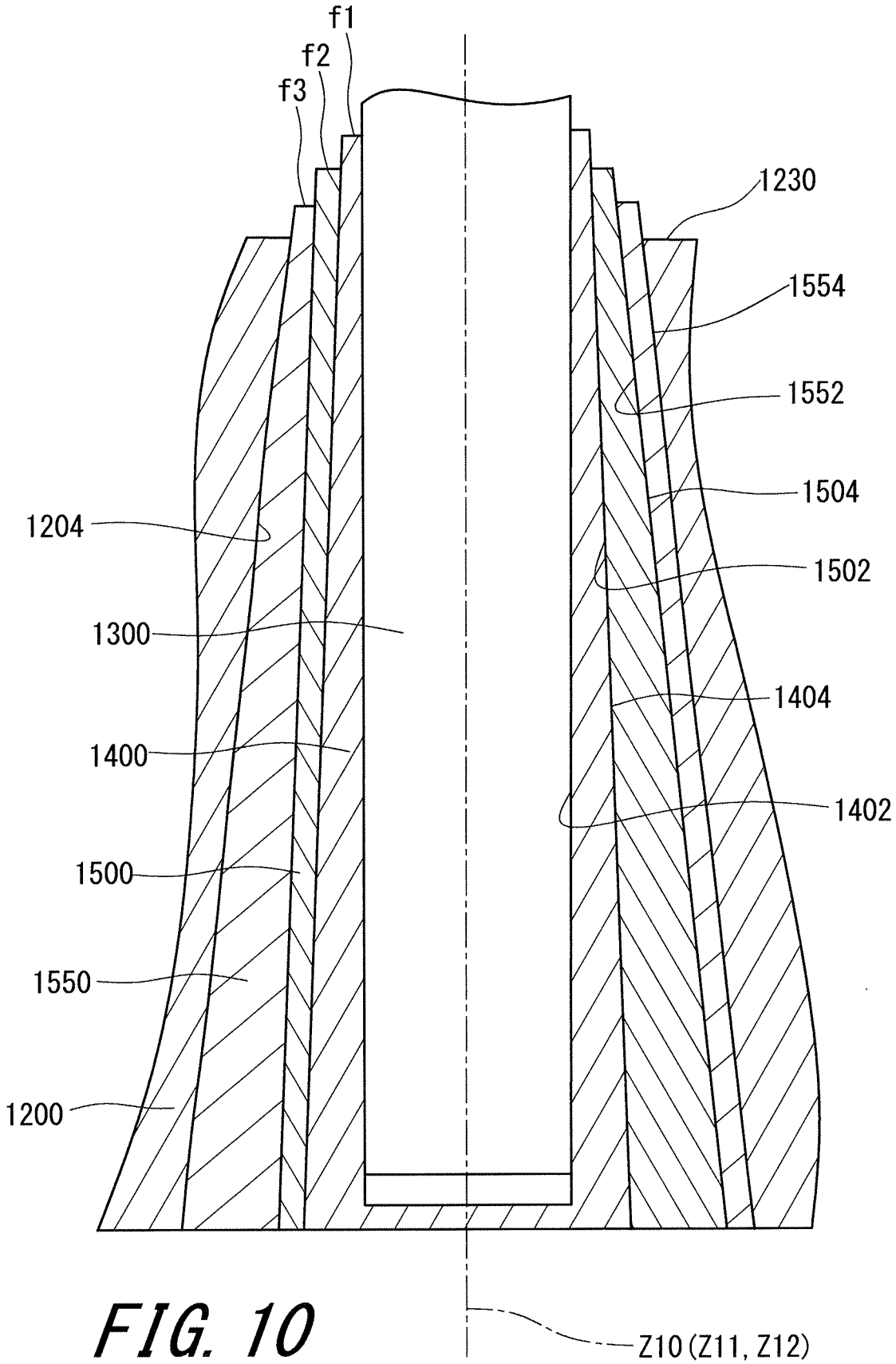
FIG. 10 is a sectional view of the golf club of FIG. 9.

FIG. 9 is an exploded perspective view of a golf club 1100 which is a second embodiment. FIG. 10 is a sectional view of the golf club 1100 in an engagement state. FIG. 10 is a sectional view of the golf club 1100 in the vicinity of a hosel.

The golf club 1100 has a head 1200, a shaft 1300, a sleeve 1400, a first spacer 1500, a second spacer 1550, and a grip (not shown). The sleeve 1400, the first spacer 1500, and the second spacer 1550 constitute an engaging part 1600. The engaging part 1600 is disposed at a tip part of the shaft 1300. An outer surface of the engaging part 1600 is formed by the second spacer 1550 (outermost spacer).

In the present embodiment, the first spacer 1500 and the second spacer 1550 are used. In the present embodiment, the number of the spacers is 2. The second spacer 1550 is located outside the first spacer 1500. The second spacer 1550 is the outermost spacer.

The head 1200 has a hosel part 1202. The hosel part 1202 has a hosel hole 1204. The hosel hole 1204 constitutes an oppositely tapered hole. The shape of the oppositely tapered hole 1204 corresponds to the shape of an outer surface of the engaging part 1600. In other words, the shape of the oppositely tapered hole 1204 corresponds to the shape of an outer surface of the second spacer 1550. In the engagement state, the outer surface of the engaging part 1600 (the outer surface of the second spacer 1550) is brought into surface-contact with the hosel hole 1204.

The hosel part 1202 has a hosel slit 1206. The hosel slit 1206 is provided on a side of the hosel part 1202. The hosel slit 1206 is provided on a heel side of the hosel part 1202.

As shown in FIG. 9, the sleeve 1400 has an inner surface 1402 and an outer surface 1404. The inner surface 1402 forms a shaft hole. The sectional shape of the inner surface 1402 is a circle. The shape of the inner surface 1402 corresponds to an outer surface of the shaft 1300. The inner surface 1402 is fixed to the tip part of the shaft 1300. That is, the sleeve 1400 is fixed to the tip part of the shaft 1300. An adhesive is used for the fixation.

The outer surface 1404 is a pyramid surface. The outer surface 1404 is a four-sided pyramid surface. The sectional shape of the outer surface 1404 is a non-circle. The sectional shape of the outer surface 1404 is a square. The area of a figure including a sectional line of the outer surface 1404 as an outer edge is larger as approaching a lower side (sole side). In other words, the area of sectional view of the outer surface 1404 is gradually increased as going to the tip side of the shaft. Thus, the sleeve 1400 is oppositely tapered-shaped.

As shown in FIG. 9, the first spacer 1500 has an inner surface 1502 and an outer surface 1504. The inner surface 1502 forms a sleeve hole. The sectional shape of the inner surface 1502 corresponds to the sectional shape of the outer surface 1404 of the sleeve 1400. The outer surface 1404 of the sleeve 1400 is fitted into the inner surface 1502. In other words, the sleeve 1400 is internally fitted into the first spacer 1500. The first spacer 1500 is not bonded to the sleeve 1400. The first spacer 1500 is merely brought into contact with the sleeve 1400.

The shape of the inner surface 1502 corresponds to the outer surface 1404 of the sleeve 1400. The inner surface 1502 is a pyramid surface. The inner surface 1502 is a four-sided pyramid surface. The sectional shape of the inner surface 1502 is a non-circle. The sectional shape of the inner surface 1502 is a square. The area of a figure including a sectional line of the inner surface 1502 as an outer edge is larger as approaching a lower side (sole side). In other words, the area of sectional view of the inner surface 1502 is gradually increased as going to the tip side of the shaft.

The shape of the outer surface 1504 corresponds to the shape of an inner surface 1552 of the second spacer 1550. The outer surface 1504 is a pyramid surface. The outer surface 1504 is a four-sided pyramid surface. The sectional shape of the outer surface 1504 is a non-circle. The sectional shape of the outer surface 1504 is a square. The area of a figure including a sectional line of the outer surface 1504 as an outer edge is larger as approaching a lower side (sole side). Thus, the first spacer 1500 is oppositely tapered-shaped. In other words, the area of sectional view of the outer surface 1504 is gradually increased as going to the tip side of the shaft.

As shown in FIG. 9, the second spacer 1550 has an inner surface 1552 and an outer surface 1554. The inner surface 1552 forms a hole which is engaged with the first spacer 1500. The sectional shape of the inner surface 1552 corresponds to the sectional shape of the outer surface 1504 of the first spacer 1500. The outer surface 1504 of the first spacer 1500 is fitted into the inner surface 1552. In other words, the first spacer 1500 is internally fitted into the second spacer 1550. The second spacer 1550 is not bonded to the first spacer 1500. The second spacer 1550 is merely brought into contact with the first spacer 1500.

The shape of the inner surface 1552 corresponds to the outer surface 1504 of the first spacer 1500. The inner surface 1552 is a pyramid surface. The inner surface 1552 is a four-sided pyramid surface. The sectional shape of the inner surface 1552 is a non-circle. The sectional shape of the inner surface 1552 is a square. The area of a figure including a sectional line of the inner surface 1552 as an outer edge is larger as approaching a lower side (sole side). In other words, the area of sectional view of the inner surface 1552 is gradually increased as going to the tip side of the shaft.

The outer surface 1554 of the outermost spacer (second spacer 1550) is also the outer surface of the engaging part 1600. The shape of the outer surface 1554 corresponds to the shape of the oppositely tapered hole 1204. The outer surface 1554 is a pyramid surface. The outer surface 1554 is a four-sided pyramid surface. The sectional shape of the outer surface 1554 is a non-circle. The sectional shape of the outer surface 1554 is a square. The area of a figure including a sectional line of the outer surface 1554 as an outer edge is larger as approaching a lower side (sole side). In other words, the area of sectional view of the outer surface 1554 is gradually increased as going to the tip side of the shaft. Thus, the second spacer 1550 is oppositely tapered-shaped. The sleeve 1400, the first spacer 1500, and the second spacer 1550 constitute the engaging part 1600.

With reference to FIG. 10, in the present embodiment, an axis line Z10 of the inner surface 1402 of the sleeve 1400 is not inclined with respect to an axis line Z11 of the outer surface 1404 of the sleeve 1400. The axis line Z10 coincides with the axis line Z11 of the outer surface 1404 of the sleeve 1400. An axis line Z12 of the shaft 1300 coincides with the axis line Z11 of the outer surface 1404 of the sleeve 1400. An axis line (abbreviated in the figure) of the inner surface 1502 of the first spacer 1500 is inclined with respect to an axis line (abbreviated in the figure) of the outer surface 1504 of the first spacer 1500. Furthermore, an axis line (abbreviated in the figure) of the inner surface 1552 of the second spacer 1550 is inclined with respect to an axis line (abbreviated in the figure) of the outer surface 1554 of the second spacer 1550. The use of the two spacers improves the degree of freedom of adjustment of the axis line Z12 of the shaft 1300.

The head 1200 has a coming-off preventing mechanism 1220 having the same structure as the structure of the above-mentioned coming-off preventing mechanism 220.

Figure 11:
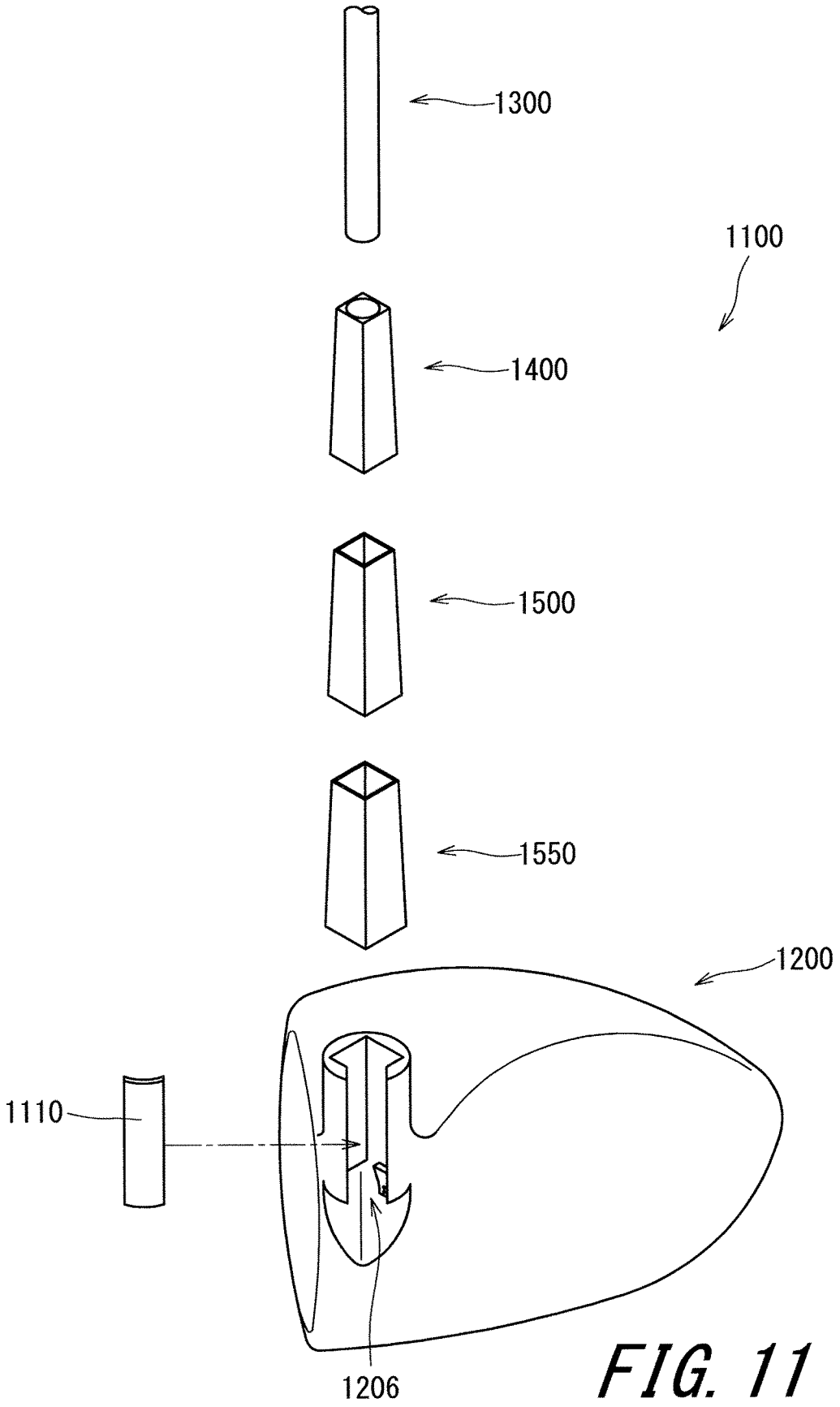
FIG. 11 is an exploded perspective view of a golf club having a cover member.

FIG. 11 is an exploded perspective view showing the above-mentioned golf club 1100 and a cover member 1110 attached to the head 1200 of the golf club 1100. The cover member 1110 is detachably attached to the head 1200. For example, the cover member 1110 may be attached to the head 1200 by a slide mechanism. The cover member 1110 covers at least a part of the hosel slit 1206. In the present embodiment, the cover member 1110 covers the whole hosel slit 1206. The hosel slit 1206 is invisible by the cover member 1110. Alternatively, the hosel slit 1206 is less-visible by the cover member 1110. The cover member 1110 can suppress a seeming uncomfortable feeling. In the golf club 1100 in an address state, the hosel slit 1206 is invisible from the golfer. Therefore, even if the cover member 1110 is not present, the hosel slit 1206 does not cause an uncomfortable feeling during addressing.

As exemplified above, the number of the spacers may be 1 or 2. The number of the spacers may be equal to or greater than 3. The spacer may not be present.

When the spacer is not present, the engaging part is constituted by only the sleeve. When one or more spacers are used, the engaging part is constituted by the sleeve and all the spacers.

When the spacer is not present, the sleeve as the engaging part is engaged with the oppositely tapered hole of the hosel hole. In this case, oppositely tapered fitting is formed between the sleeve and the oppositely tapered hole. In the oppositely tapered fitting, contact pressure is increased by a force in an engaging direction to form firm engaging. All large forces acting during swinging are the force in the engaging direction. Therefore, anti-rotation and retention are achieved.

When the number of the spacers is 1, the spacer located outside the sleeve is engaged with the oppositely tapered hole of the hosel hole. In this case, oppositely tapered fitting is formed between the spacer and the oppositely tapered hole. In addition, oppositely tapered fitting is formed between the sleeve and the spacer. In these oppositely tapered fittings, contact pressure is increased by a force in an engaging direction to form firm engaging. Therefore, anti-rotation and retention are achieved.

When the number of the spacers is 2, the second spacer (outermost spacer) is engaged with the oppositely tapered hole of the hosel hole. In this case, oppositely tapered fitting is formed between the second spacer and the oppositely tapered hole. In addition, oppositely tapered fitting is formed between the first spacer and the second spacer. In addition, oppositely tapered fitting is formed between the sleeve and the first spacer. In these oppositely tapered fittings, contact pressure is increased by a force in an engaging direction to form firm engaging. Therefore, anti-rotation and retention are achieved.

Figure 12:
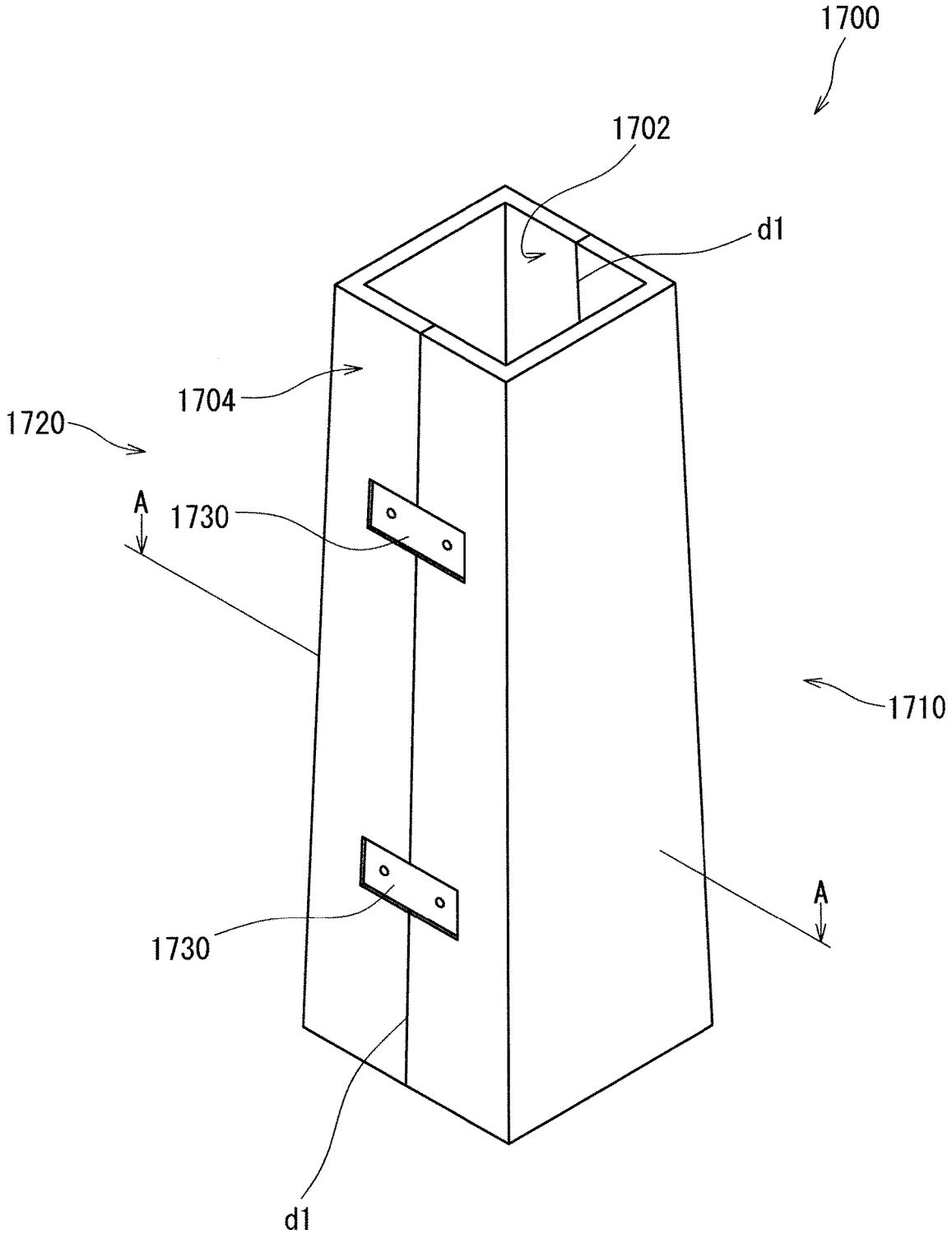
FIG. 12 is a perspective view of a spacer according to modification example.
Figure 13A:
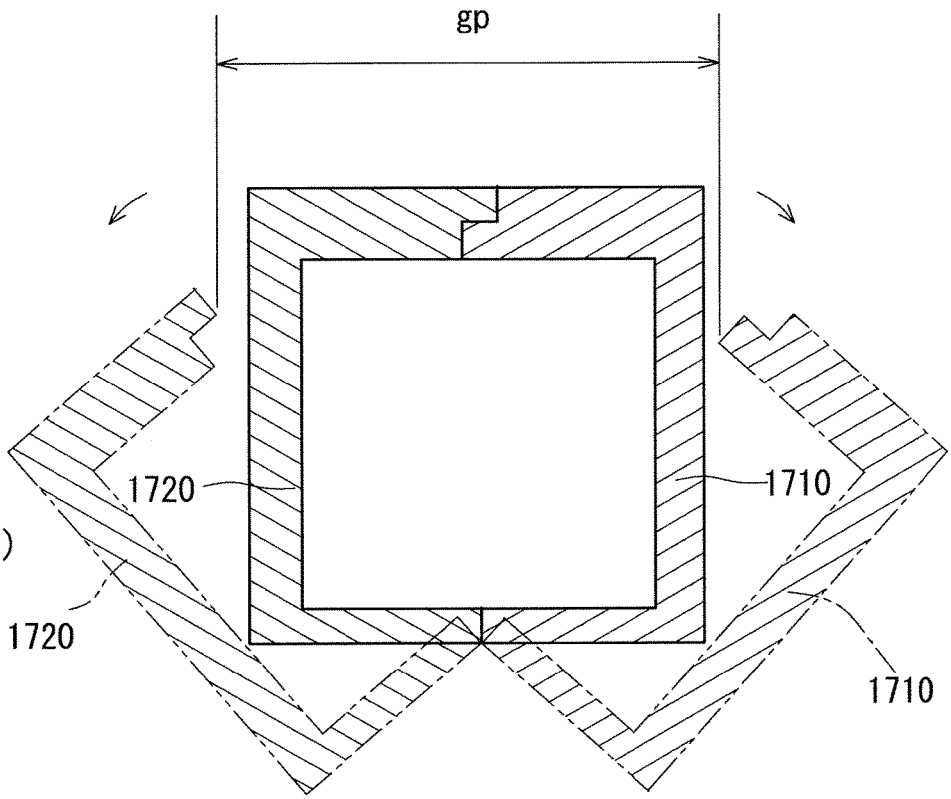
FIG. 13(*a*) is a sectional view taken along line A-A of FIG. 12.
Figure 13B:
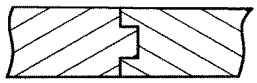
Figure 13C:
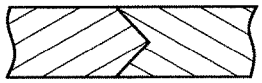

FIG. 12 is a perspective view of a spacer 1700 according to modification example. FIG. 13(*a*) is a sectional view taken along line A-A of FIG. 12. The spacer 1700 is an example of a replaceable spacer.

As with the above-mentioned spacer 500 or the like, the spacer 1700 has an inner surface 1702 and an outer surface 1704.

The above-mentioned whole spacer 500 or the like is integrally molded. Meanwhile, the spacer 1700 has a divided structure. The spacer 1700 has a first divided body 1710 and a second divided body 1720. A division line dl is shown in FIG. 12. The division line dl is a boundary between the first divided body 1710 and the second divided body 1720.

The spacer 1700 has a connecting part 1730. In the present embodiment, the connecting part 1730 is a leaf spring. The leaf spring is an elastic body. In the present embodiment, the two connecting parts 1730 are provided. One side of the connecting part 1730 is fixed to the first divided body 1710, and the other side of the connecting part 1730 is fixed to the second divided body 1720.

The connecting part 1730 is accommodated in a recess provided in the outer surface 1704. The connecting part 1730 is not protruded to the outside of the outer surface 1704. The connecting part 1730 does not inhibit the contact between an oppositely tapered surface into which the outer surface 1704 is fitted and the outer surface 1704. The oppositely tapered surface into which the outer surface 1704 is fitted is the oppositely tapered hole of the head or the inner surface of the other spacer.

The connecting part 1730 functions as a hinge. The spacer 1700 is opened around the connecting part 1730. The spacer 1700 is opened by an external force. The state where the spacer 1700 is opened is shown by a two-dot chain line in FIG. 13(*a*). When the connecting part 1730 (leaf spring) is bent, the spacer 1700 is opened. In the state where the spacer 1700 is opened, a gap gp is formed between the first divided body 1710 and the second divided body 1720. From the gap gp, the shaft can be introduced into the spacer 1700. The spacer 1700 is closed in the state where the shaft is introduced. The leaf spring 1730 biases the spacer 1700 so as to bring about the state where the spacer 1700 is closed. Therefore, if the external force is eliminated, the spacer 1700 is closed.

The openable spacer 1700 enables the spacer to be replaced. As shown in FIG. 4(*a*), in the shaft assembly 700, the spacer 500 can move in the axial direction on the shaft 300, but it cannot be separated from the shaft 300. This is because the sleeve 400 is fixed to the shaft 300 so that the sleeve 400 cannot be attached/detached. However, the spacer 1700 can take in the shaft 300 from the side. Therefore, the spacer 1700 can be attached to, and detached from the shaft 300 to which the sleeve 400 is fixed.

The spacer 1700 has a position adjustment structure for preventing a position displacement between the first divided body 1710 and the second divided body 1720. As the position adjustment structure, a flat plate splicing structure may be applied. The embodiment of FIG. 13(*a*) includes an example of the position adjustment structure. In the position adjustment structure, a level difference of a first member and a level difference of the second member are butted each other. The outside of the first member in the thickness direction and the inside of the second member in the thickness direction are overlapped. The first member is one of the first divided body 1710 or the second divided body 1720, and the second member is the other of the first divided body 1710 or the second divided body 1720.

FIG. 13(*b*) shows another position adjustment structure. The position adjustment structure is also known as the flat plate splicing structure. In the position adjustment structure, a projection of a first member and a recess of a second member are butted each other. The center side of the first member in the thickness direction, and the inside and outside of the second member in the thickness direction are overlapped. The first member is one of the first divided body 1710 or the second divided body 1720, and the second member is the other of the first divided body 1710 or the second divided body 1720.

FIG. 13(*c*) shows another position adjustment structure. The position adjustment structure is also known as the flat plate splicing structure. In the position adjustment structure, a projection of a first member and a recess of a second member are butted each other. The section of the projection of the first member is constituted by a slope face. The section of the recess of the second member is constituted by a slope face. The center side of the first member in the thickness direction, and the inside and outside of the second member in the thickness direction are overlapped. The first member is one of the first divided body 1710 or the second divided body 1720, and the second member is the other of the first divided body 1710 or the second divided body 1720.

The position adjustment structures as shown in FIGS. 13(*a*) to 13(*c*) prevent the position displacement in the thickness direction. In addition, a structure for preventing the position displacement in the axial direction may be adopted. For example, the position adjustment structures as shown in FIGS. 13(*a*) to 13(C) are adopted only for a part of the axial direction, and thereby the position displacement in the axial direction can also be prevented. For example, in the embodiment of FIG. 13(*a*), the position adjustment structure is adopted only for an intermediate portion in the axial direction, and the position adjustment structure is not adopted in the other portions (upper end portion and lower end portion).

Figure 14:
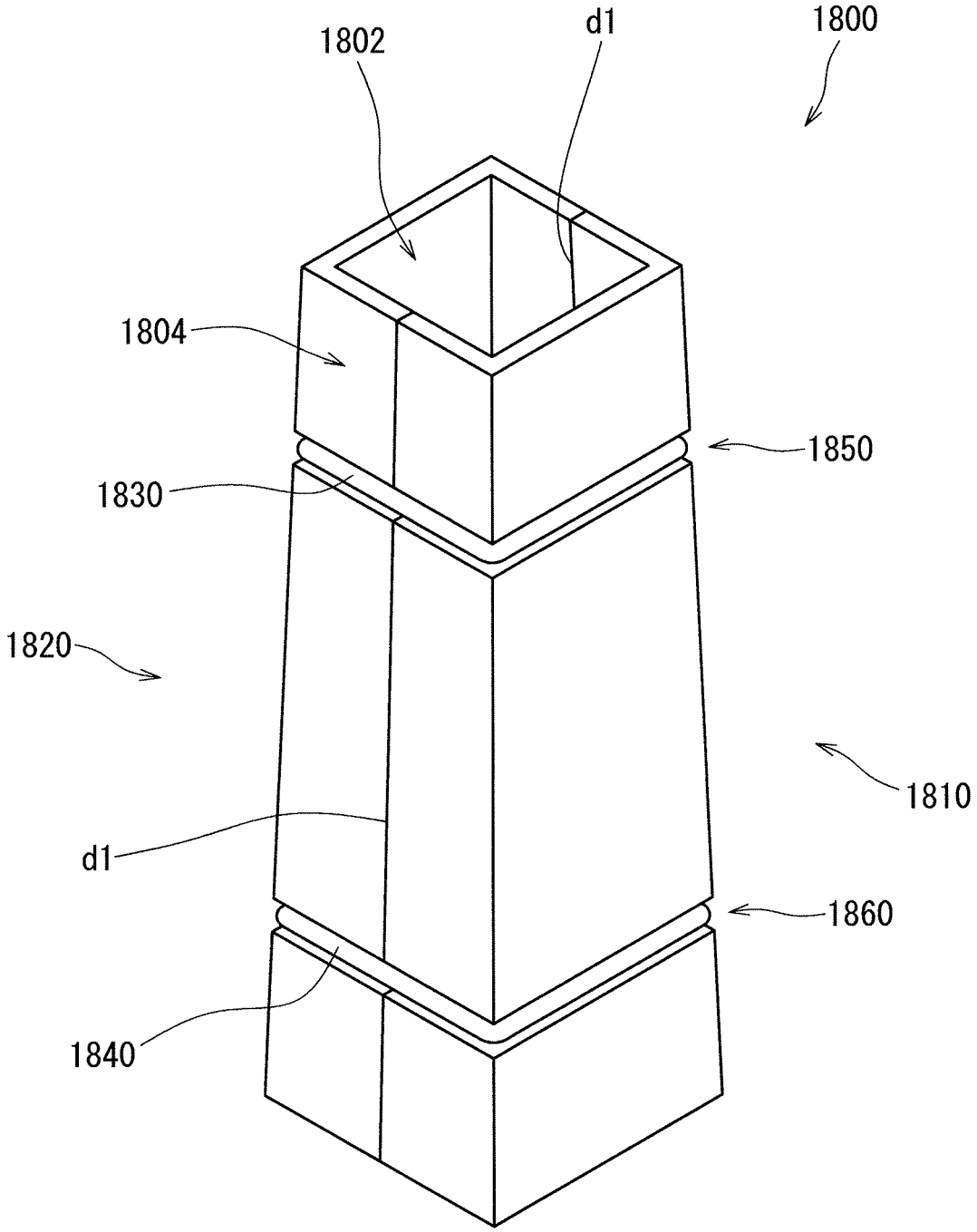
FIG. 14 is a perspective view of a spacer according to another modification example.

FIG. 14 is a perspective view of a spacer 1800 according to another modification example. As with the above-mentioned spacer 500 or the like, the spacer 1800 has an inner surface 1802 and an outer surface 1804.

As with the spacer 1700, the spacer 1800 has a divided structure. The spacer 1800 has a first divided body 1810 and a second divided body 1820. A division line dl is shown in FIG. 14. The division line dl is a boundary between the first divided body 1810 and the second divided body 1820.

The spacer 1800 has ring-shaped elastic bodies 1830 and 1840. The spacer 1800 further has circumferential grooves 1850 and 1860. The elastic bodies 1830 and 1840 are fitted into the circumferential grooves 1850 and 1860. The elastic bodies 1830 and 1840 are not protruded to the outside of the outer surface 1804. The elastic bodies 1830 and 1840 do not inhibit the contact between an oppositely tapered surface into which the outer surface 1804 is fitted and the outer surface 1804. The oppositely tapered surface into which the outer surface 1804 is fitted is the oppositely tapered hole of the head or the inner surface of the other spacer.

The elastic bodies 1830 and 1840 are stretched by applying an external force, and thereby the elastic bodies 1830 and 1840 can be detached. If the elastic bodies 1830 and 1840 are detached, the first divided body 1810 and the second divided body 1820 can be separated from each other. On the contrary, after the first divided body 1810 and the second divided body 1820 are butted each other, the elastic bodies 1830 and 1840 can be attached. The elastic contractile forces of the elastic bodies 1830 and 1840 bias the two division bodies 1810 and 1820 so that the division bodies 1810 and 1820 are butted each other. For example, such a spacer 1800 also enables the spacer to be replaced.

The spacer 1700 and the spacer 1800 have the first divided body and the second divided body. These enable a mutual shift between a combination state and a separation state. In the combination state, the first divided body and the second divided body are combined, and in the separation state, a gap is formed between the first divided body and the second divided body. In the separation state, the shaft is made to pass through the gap, and thereby the shaft can be disposed in the spacer.

[Rotation Position of Sleeve]

The sleeve can be rotated around the axis line of the sleeve itself . The rotation position of the sleeve is changed by the rotation. In the engagement state, the sleeve can take a plurality of rotation positions. The number of the rotation positions which can be taken is set based on the shape of the outer surface of the sleeve.

[Rotation Position of Spacer]

The spacer can be rotated around the axis line of the spacer itself . The rotation position of the spacer is changed by the rotation. In the engagement state, the spacer can take a plurality of rotation positions. The number of the rotation positions which can be taken is set based on the shape of the outer surface of the spacer.

[Adjustment of Position and Direction of Axis Line of Shaft]

The axis line of the shaft hole (the axis line of the shaft) can be displaced with respect to the axis line of the outer surface of the sleeve. These axis lines may be inclined with respect to each other, or may be displaced in parallel to each other (parallel and eccentric) . Inclination and eccentricity may be combined. In this case, the direction and/or the position of the axis line of the shaft can be changed by the rotation position of the sleeve.

The axis line of the inner surface of the spacer can be displaced with respect to the axis line of the outer surface of the spacer. These axis lines may be inclined with respect to each other, or may be displaced in parallel to each other (parallel and eccentric) . Inclination and eccentricity may be combined. In this case, the direction and/or the position of the axis line of the shaft can be changed by the rotation position of the spacer.

The rotation position of the spacer can be selected independently of the rotation position of the sleeve. When a plurality of spacers are used, the rotation position of each of the spacers can be independently selected. The degree of freedom of the adjustment is improved by the spacer. By the plurality of spacers, the degree of freedom of the adjustment is further improved. From these viewpoints, the number of the spacers is preferably 1, or equal to or greater than 2. In light of the complexity of the adjustment and the miniaturization of the hosel part, the number of the spacers is more preferably 1 or 2.

FIGS. 15 to 20 are plan views of the end face (lower end face) of the engaging part. Changes in the position and the direction of the axis line of the shaft will be described using these plan views.

FIGS. 15 to 18 are plan views of the lower end face of an embodiment A in which the number of the spacers is 1. In the present embodiment, a sleeve sv1 and a spacer sp1 are used. A position Zs of the axis line of the shaft in the lower end of the hosel hole is shown by the intersection point of solid lines. The intersection point of dashed dotted lines shows the position of the axis line of the shaft in the upper end of the hosel hole. In the present embodiment, the position of the axis line of the shaft in the upper end of the hosel hole is not changed regardless of the rotation positions of the sleeve sv1 and the spacer sp1.

The embodiment A shown in FIGS. 15 to 18 satisfy the following items.

(A1) An axis line of an inner surface of the sleeve sv1 (that is, the axis line of the shaft) is inclined with respect to an axis line of an outer surface of the sleeve sv1.

(A2) An axis line of an inner surface of the spacer sp1 is inclined with respect to an axis line of an outer surface of the spacer sp1.

As with the above-mentioned golf club 100, in the embodiment A, the outer surface of the sleeve sv1 is a four-sided pyramid surface. Each of the inner and outer surfaces of the spacer sp1 is also a four-sided pyramid surface, and an oppositely tapered hole is also a four-sided pyramid surface. Therefore, the number of the rotation positions of the sleeve sv1 is 4, and the number of the rotation positions of the spacer sp1 is also 4. In the embodiment A, 16 (4×4) kinds of combinations of the rotation positions of the sleeve sv1 and the rotation positions of the spacer sp1 are set. A golf club according to the embodiment A has an excellent degree of freedom of adjustment. All the 16 kinds of combinations are shown in FIGS. 15 to 18.

Figure 15:
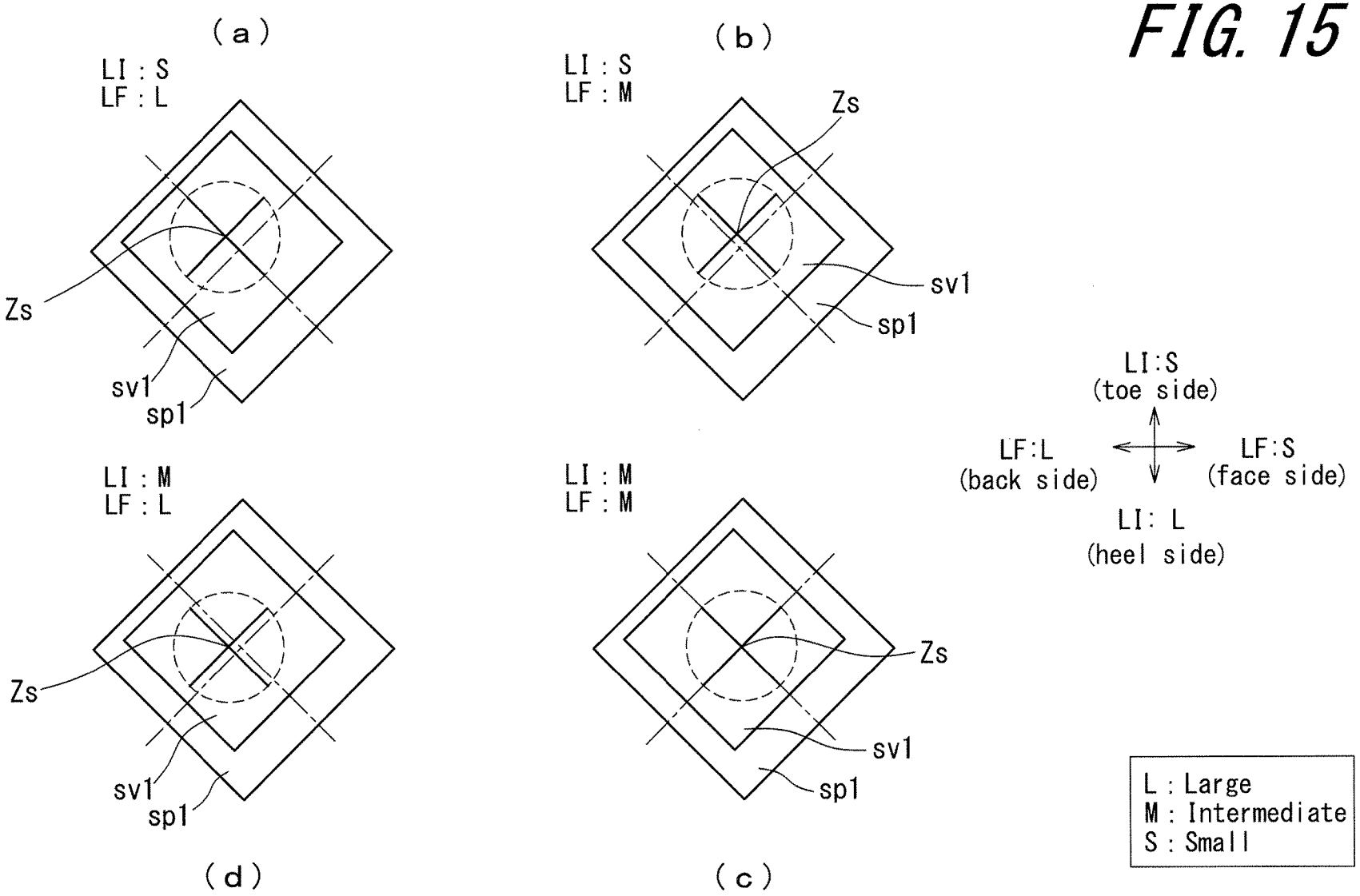
FIG. 15 is a plan view of a lower end face of an engaging part, and shows change in the position of an axis line of a shaft. 16 kinds of constitutions enabled when the number of spacers is 1 are shown in FIGS. 15 to 18.

In FIG. 15(*a*), the rotation position of the sleeve sv1 is a first position, and the rotation position of the spacer sp1 is the first position. In FIG. 15(*b*), the rotation position of the sleeve sv1 is a second position, and the rotation position of the spacer sp1 is the first position. In FIG. 15(*c*), the rotation position of the sleeve sv1 is a third position, and the rotation position of the spacer sp1 is the first position. In FIG. 15(*d*), the rotation position of the sleeve sv1 is a fourth position, and the rotation position of the spacer sp1 is the first position.

Figure 16:
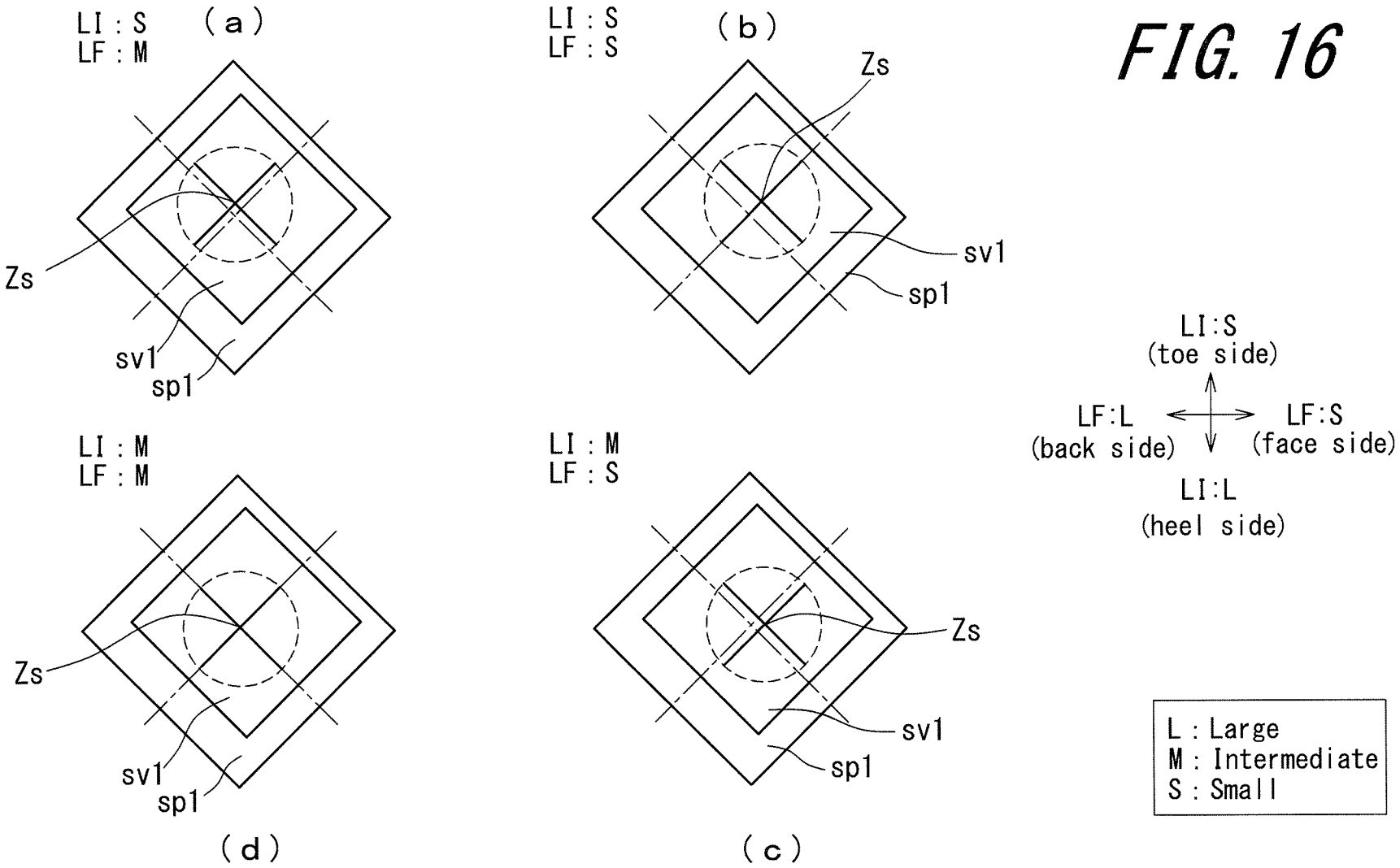
FIG. 16 is also a plan view of a lower end face of an engaging part, and shows change in the position of an axis line of a shaft.

In FIG. 16(*a*), the rotation position of the sleeve sv1 is the first position, and the rotation position of the spacer sp1 is the second position. In FIG. 16(*b*), the rotation position of the sleeve sv1 is the second position, and the rotation position of the spacer sp1 is the second position. In FIG. 16(*c*), the rotation position of the sleeve sv1 is the third position, and the rotation position of the spacer sp1 is the second position. In FIG. 16(*d*), the rotation position of the sleeve sv1 is the fourth position, and the rotation position of the spacer sp1 is the second position.

Figure 17:
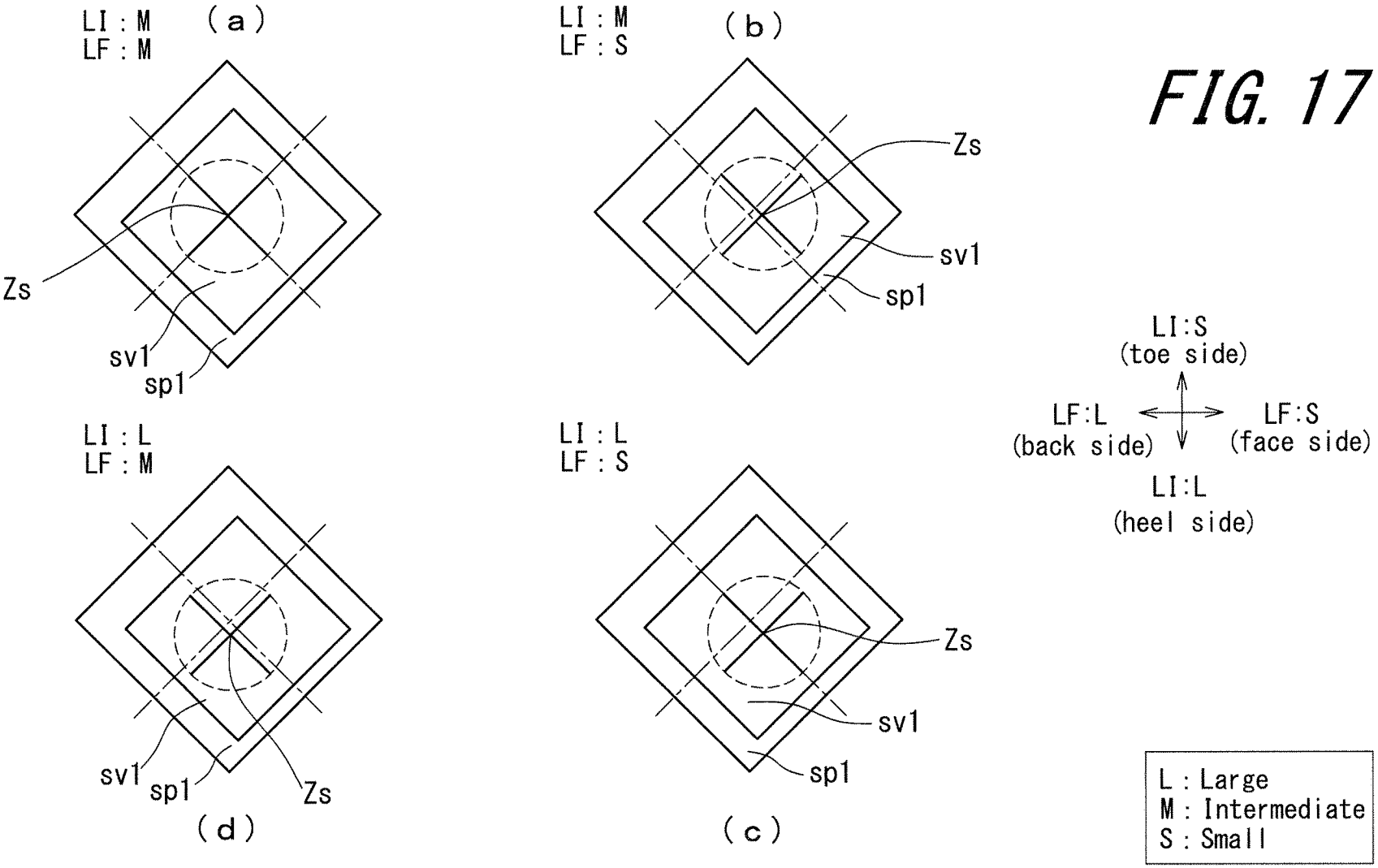
FIG. 17 is also a plan view of a lower end face of an engaging part, and shows change in the position of an axis line of a shaft.

In FIG. 17(*a*), the rotation position of the sleeve sv1 is the first position, and the rotation position of the spacer sp1 is the third position. In FIG. 17(*b*), the rotation position of the sleeve sv1 is the second position, and the rotation position of the spacer sp1 is the third position. In FIG. 17(*c*), the rotation position of the sleeve sv1 is the third position, and the rotation position of the spacer sp1 is the third position. In FIG. 17(*d*), the rotation position of the sleeve sv1 is the fourth position, and the rotation position of the spacer sp1 is the third position.

Figure 18:
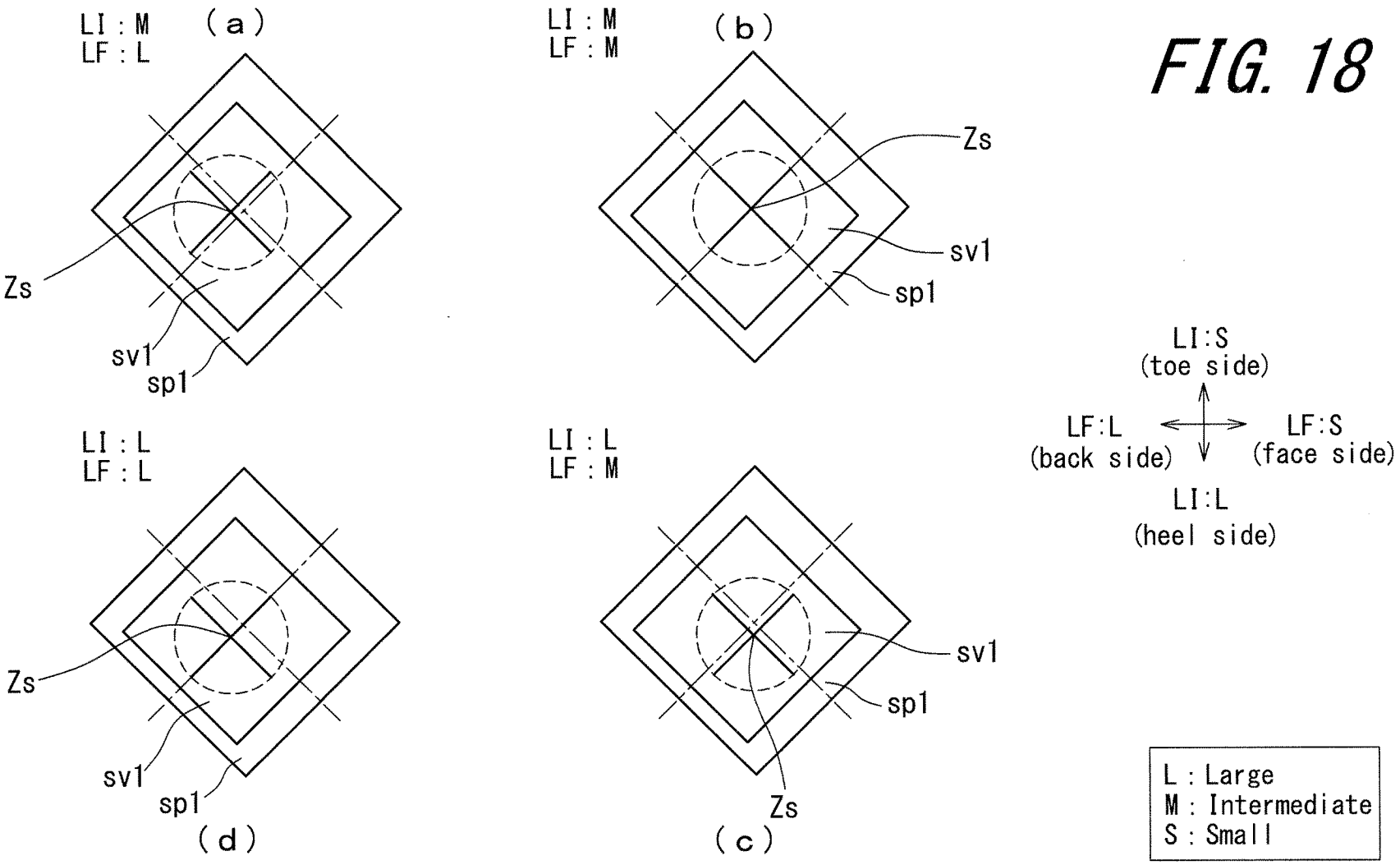
FIG. 18 is also a plan view of a lower end face of an engaging part, and shows change in the position of an axis line of a shaft.

In FIG. 18(*a*), the rotation position of the sleeve sv1 is the first position, and the rotation position of the spacer sp1 is the fourth position. In FIG. 18(*b*), the rotation position of the sleeve sv1 is the second position, and the rotation position of the spacer sp1 is the fourth position. In FIG. 18(*c*), the rotation position of the sleeve sv1 is the third position, and the rotation position of the spacer sp1 is the fourth position. In FIG. 18(*d*), the rotation position of the sleeve sv1 is the fourth position, and the rotation position of the spacer sp1 is the fourth position.

The 16 kinds of combinations include 9 kinds of positions Zs. That is, the axis lines of the shaft can be changed to 9 kinds.

In FIGS. 15 to 18, the transverse direction of the drawing is a face-back direction. The right side of the drawing is a face side, and the left side of the drawing is a back side. As the position Zs is closer to the rightmost side, the loft angle (LF) is smaller. As the position Zs is closer to the leftmost side, the loft angle (LF) is larger. The club according to the present embodiment is right-handed.

In FIGS. 15 to 18, the lengthwise direction of the drawing is a toe-heel direction. The upper side of the drawing is a toe side, and the lower side of the drawing is a heel side. As the position Zs is closer to the uppermost side, the lie angle (LI) is smaller. As the position Zs is closer to the lowermost side, the lie angle (LI) is larger.

According to the 9 kinds of axis lines of the shaft, 9 kinds of specifications of the combinations of the loft angles and the lie angles will be described later.

(Specification 1) The lie angle (LI) is small and the loft angle (LF) is small.

(Specification 2) The lie angle (LI) is small and the loft angle (LF) is intermediate.

(Specification 3) The lie angle (LI) is small and the loft angle (LF) is large.

(Specification 4) The lie angle (LI) is intermediate and the loft angle (LF) is small.

(Specification 5) The lie angle (LI) is intermediate and the loft angle (LF) is intermediate.

(Specification 6) The lie angle (LI) is intermediate and the loft angle (LF) is large.

(Specification 7) The lie angle (LI) is large and the loft angle (LF) is small.

(Specification 8) The lie angle (LI) is large and the loft angle (LF) is intermediate.

(Specification 9) The lie angle (LI) is large and the loft angle (LF) is large.

In the golf club according to the embodiment A, the independent variability of the loft angle is achieved. In the golf club according to the embodiment A, the independent variability of the lie angle is achieved. In the embodiment A, the direction (phase) of the oppositely tapered hole (hosel hole) is set so that the independent variability of the loft angle and the independent variability of the lie angle are achieved.

For example, among the specifications 1, 2, and 3, the loft angle is changed without changing the lie angle. This is one example of the independent variability of the loft angle. The same independent variability is provided also among the specifications 4, 5, and 6. The same independent variability is provided also among the specifications 7, 8, and 9.

For example, among the specifications 1, 4, and 7, the lie angle is changed without changing the loft angle. This is one example of the independent variability of the lie angle. The same independent variability is provided also among the specifications 2, 5, and 8. The same independent variability is provided also among the specifications 3, 6, and 9.

The independent variability of the loft angle means that the loft angle is changed without substantially changing the lie angle. The phrase "without substantially changing" means that change in the lie angle is equal to or less than 20% based on the amount of change in the loft angle. The independent variability of the lie angle means that the lie angle is changed without substantially changing the loft angle. The phrase "without substantially changing" means that change in the loft angle is equal to or less than 20% based on the amount of change in the lie angle.

Figure 19:
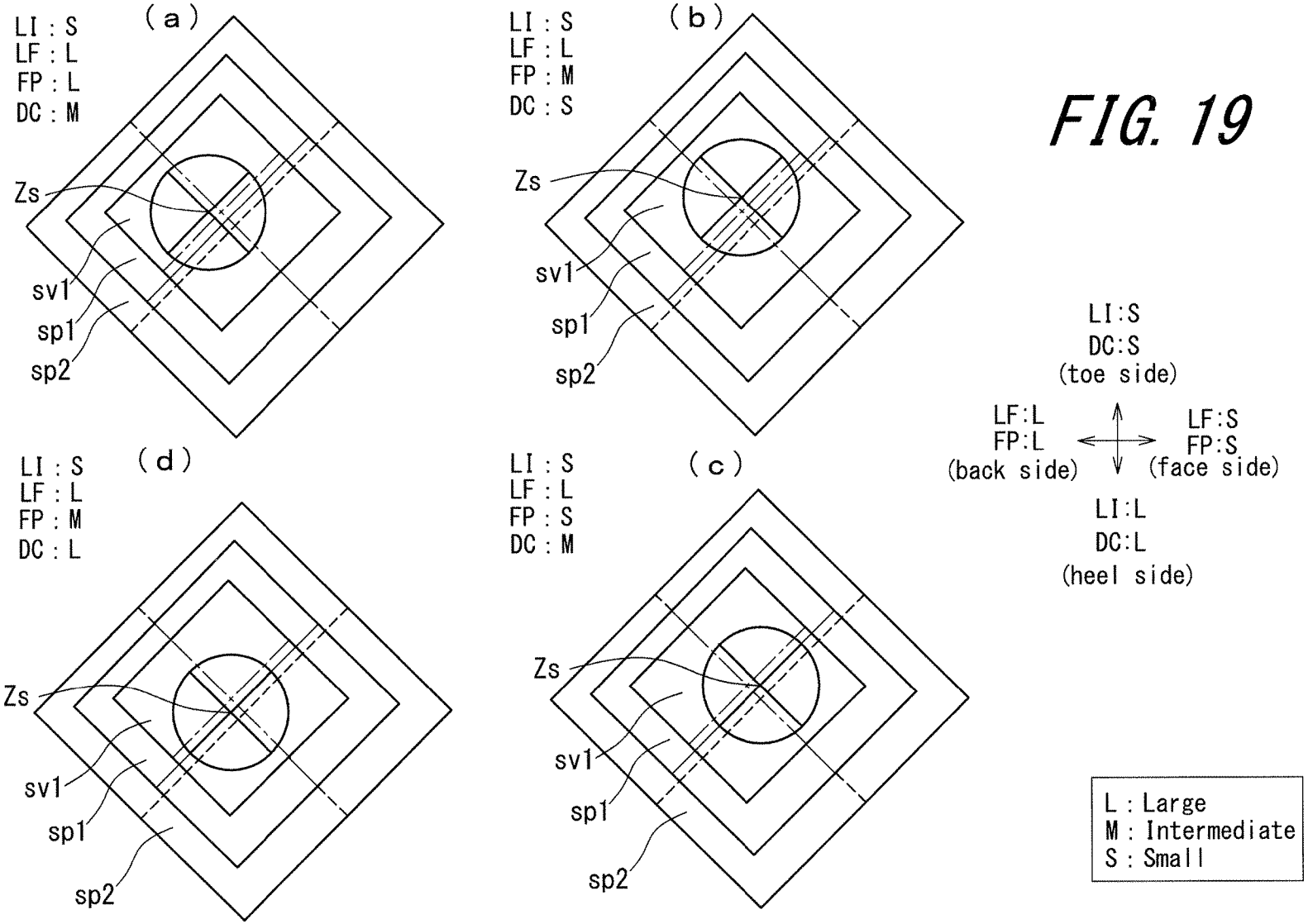
FIG. 19 is a plan view of a lower end face of an engaging part, and shows change in the position of an axis line of a shaft. 8 kinds of 64 kinds of constitutions enabled when the number of spacers is 2 are shown in FIGS. 19 and 20.
Figure 20:
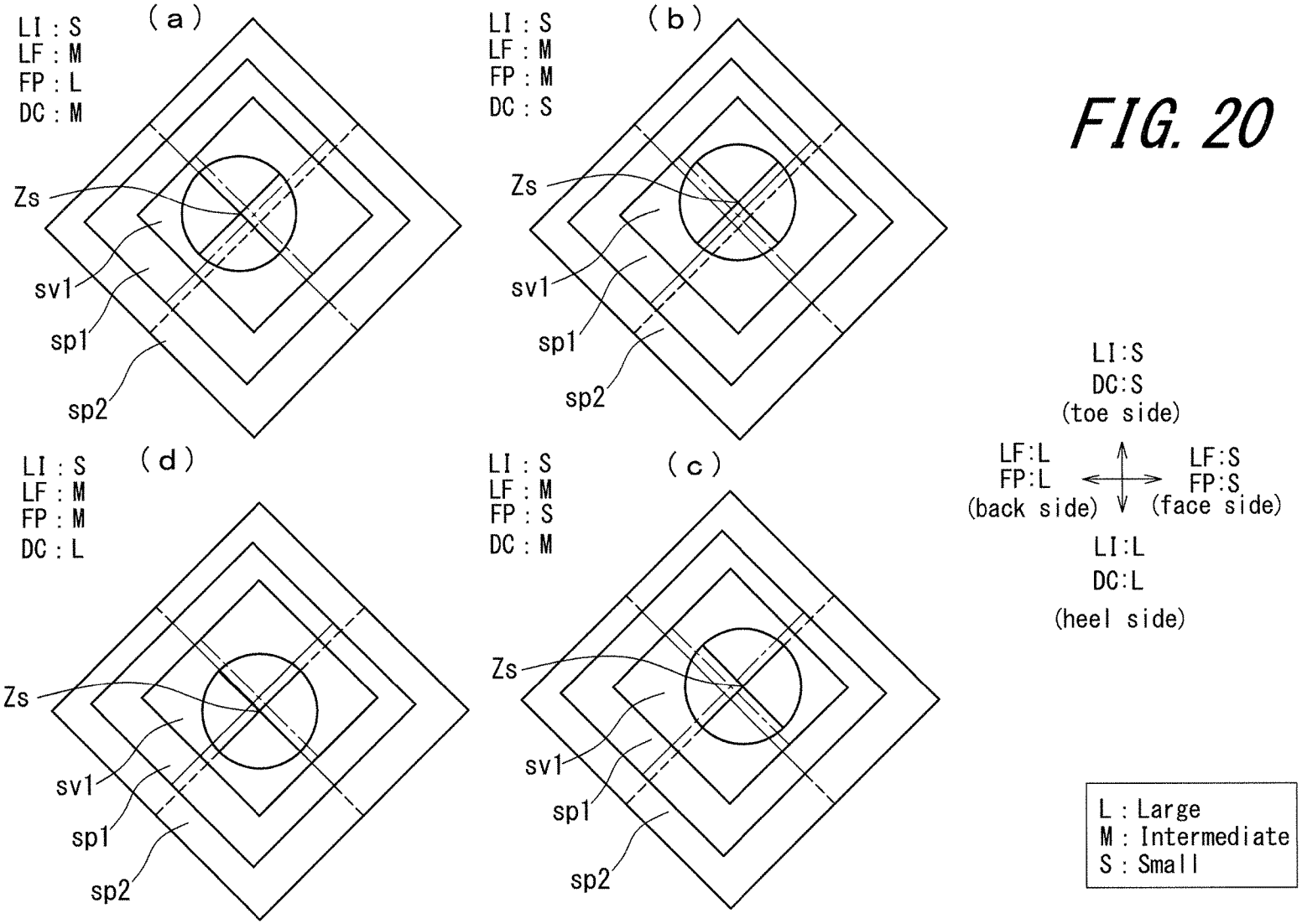
FIG. 20 is a plan view of a lower end face of an engaging part, and shows change in the position of an axis line of a shaft.

FIGS. 19 and 20 are plan views of the lower end face of an embodiment B in which the number of the spacers is 2. In the present embodiment, a sleeve sv1, a first spacer sp1, and a second spacer sp2 are used. A position Zs of the axis line of the shaft in the lower end of the hosel hole is shown by the intersection point of thick solid lines. The intersection point of dashed dotted lines shows the position of the axis line of the outer surface of the sleeve sv1 in the lower end of the hosel hole. The intersection point of thin solid lines shows the position of the axis line of the outer surface of the spacer sp1 in the lower end of the hosel hole. The intersection point of dashed lines shows the position of the axis line of the outer surface of the spacer sp2 in the lower end of the hosel hole. Regardless of the rotation positions of the sleeve sv1, the spacer sp1, and the spacer sp2, the three axis lines cross at one point at the position of the upper end of the hosel hole.

As with the above-mentioned golf club 100, in the embodiment B, an outer surface of the sleeve sv1 is a four-sided pyramid surface. Each of inner and outer surfaces of the first spacer sp1 is also a four-sided pyramid surface, and each of inner and outer surfaces of the second spacer sp2 is also a four-sided pyramid surface. An oppositely tapered hole is also a four-sided pyramid surface. Therefore, the number of the rotation positions of the sleeve sv1 is 4; the number of the rotation positions of the first spacer sp1 is also 4; and the number of the rotation positions of the second spacer sp2 is also 4. In the embodiment B, 64 (4×4×4) kinds of combinations of the three rotation positions are set. A golf club according to the embodiment B has an excellent degree of freedom of adjustment.

The embodiment B shown in FIGS. 19 and 20 satisfies the following items.

(B1) An axis line of an inner surface of the sleeve sv1 (that is, the axis line of the shaft) is parallel and eccentric to an axis line of an outer surface of the sleeve sv1.

(B2) An axis line of an inner surface of the first spacer sp1 is inclined with respect to an axis line of an outer surface of the first spacer sp1.

(B3) An axis line of an inner surface of the second spacer sp1 is inclined with respect to an axis line of an outer surface of the second spacer sp2.

The phrase "parallel and eccentric" means eccentricity in which axis lines are parallel to each other.

The relation between the first spacer sp1 and the second spacer sp2 in the embodiment B is the same as the relation between the sleeve sv1 and the spacer sp1 in the above-mentioned embodiment A. Therefore, 9 kinds of combinations of the loft angles and the lie angles are achieved by the first spacer sp1 and the second spacer sp1. Furthermore, in the embodiment B, adjustment due to the sleeve sv1 is added. Since the sleeve sv1 is parallel and eccentric, each of the positions of the nine shaft axes can be further moved in parallel. The parallel movement of the shaft axis can change face progression. The parallel movement can achieve the movement of the shaft axis in the face-back direction. The parallel movement can achieve the movement of the shaft axis in the toe-heel direction. In the embodiment B, the degree of freedom of adjustment of the shaft axis is further improved by the two spacers.

FIGS. 19 and 20 show only 8 kinds of the above-mentioned 64 kinds.

In FIGS. 19(*a*) to 19(*d*), the rotation position of the first spacer sp1 is a first position, and the rotation position of the second spacer sp2 is also the first position. In FIGS. 19(*a*) to 19(*d*), only the rotation position of the sleeve sv1 is changed without changing the rotation positions of the first spacer sp1 and the second spacer sp2. In FIG. 19(*a*), the rotation position of the sleeve sv1 is the first position. In FIG. 19(*b*), the rotation position of the sleeve sv1 is the second position. In FIG. 19(*c*), the rotation position of the sleeve sv1 is a third position. In FIG. 19(*d*), the rotation position of the sleeve sv1 is a fourth position.

In FIGS. 20(*a*) to 20(*d*), the rotation position of the first spacer sp1 is the second position, and the rotation position of the second spacer sp2 is the first position. Also in FIGS. 20(*a*) to 20(*d*), only the rotation position of the sleeve sv1 is changed without changing the rotation positions of the first spacer sp1 and the second spacer sp2. In FIG. 20(*a*), the rotation position of the sleeve sv1 is the first position. In FIG. 20(*b*), the rotation position of the sleeve sv1 is the second position. In FIG. 20(*c*), the rotation position of the sleeve sv1 is the third position. In FIG. 20(*d*), the rotation position of the sleeve sv1 is the fourth position.

In comparison of FIG. 19 with FIG. 20, in FIGS. 19(*a*) to 19(*d*), the rotation position of the first spacer sp1 is the first position, in contrast, in FIGS. 20(*a*) to 20(*d*), the rotation position of the first spacer sp1 is the second position. Due to the difference, the loft angle in each of FIGS. 20(*a*) to 20(*d*) is decreased from large one to intermediate one as compared with each of FIGS. 19(*a*) to 19(*d*).

In FIGS. 19(*a*) to 19(*d*), the rotation position of the sleeve sv1 changes from the first position to the fourth position. Due to the change, face progression (FP) which is an index showing the position of the axis line of the shaft in the face-back direction changes in order of large (L), intermediate (M), small (S), and intermediate (M) ones. Simultaneously, the distance of the center of gravity (DC) which is an index showing the position of the axis line of the shaft in the toe-heel direction changes in order of intermediate (M), small (S), intermediate (M), and large (L) ones. The distance of the center of gravity (DC) is a distance between the center of gravity of the head and the axis line of the shaft. The distance is measured in an image projected to a plane which is parallel to the toe-heel direction and includes the axis line of the shaft.

Therefore, for example, in comparison of FIG. 19A with FIG. 19(*c*), the position of the axis line of the shaft (the position of the axis line of the shaft in the upper end of the hosel hole) moves in the face-back direction while maintaining the inclination of the axis line of the shaft so that the lie angle is small (S) and the loft angle is large (L). In addition, between FIGS. 19(*a*) and 19(*c*), the distance of the center of gravity is intermediate (M) without change.

In comparison of FIG. 19(*b*) with FIG. 19(*d*), the position of the axis line of the shaft (the position of the axis line of the shaft in the upper end of the hosel hole) moves in the toe-heel direction while maintaining the inclination of the axis line of the shaft so that the lie angle is small (S) and the loft angle is large (L). In addition, between FIGS. 19(*b*) and 19(*d*), the face progression is intermediate (M) without change.

Also in FIGS. 20(*a*) to 20(*d*), the rotation position of the sleeve sv1 changes from the first position to the fourth position. Due to the change, the face progression changes in order of large (L), intermediate (M), small (S), and intermediate (M) ones. Simultaneously, the distance of the center of gravity changes in order of intermediate (M), small (S), intermediate (M), and large (L) ones.

Therefore, for example, in comparison of FIG. 20(*a*) with FIG. 20(*c*), the position of the axis line of the shaft (the position of the axis line of the shaft in the upper end of the hosel hole) moves in the face-back direction while maintaining the inclination of the axis line of the shaft so that the lie angle is small (S) and the loft angle is intermediate (M). In addition, between FIGS. 20(*a*) and 20(*c*), the distance of the center of gravity is intermediate (M) without change.

In comparison of FIG. 20(*b*) with FIG. 20(*d*), the position of the line axis of the shaft (the position of the axis line of the shaft in the upper end of the hosel hole) moves in the toe-heel direction while maintaining the inclination of the axis line of the shaft so that the lie angle is small (S) and the loft angle is intermediate (M). In addition, between FIGS. 20(*b*) and 20(*d*), the face progression is intermediate (M) without change.

Although the axis displacement of the sleeve sv1 is parallel eccentricity in the present embodiment, the axis displacement may be naturally inclination, for example. Of course, parallel eccentricity may be adopted for the spacer.

As shown in FIGS. 15 to 20, the position of the axis line of the shaft on the sole side may be variously changed. Since the present embodiment eliminates screw fixation, the degrees of freedom of the position and the inclination of the axis line of the shaft are high. Therefore, the width of angle adjustment can be increased. The width of adjustment for the loft angle, the lie angle, the face angle, and the face progression or the like can be increased.

Figure 21:
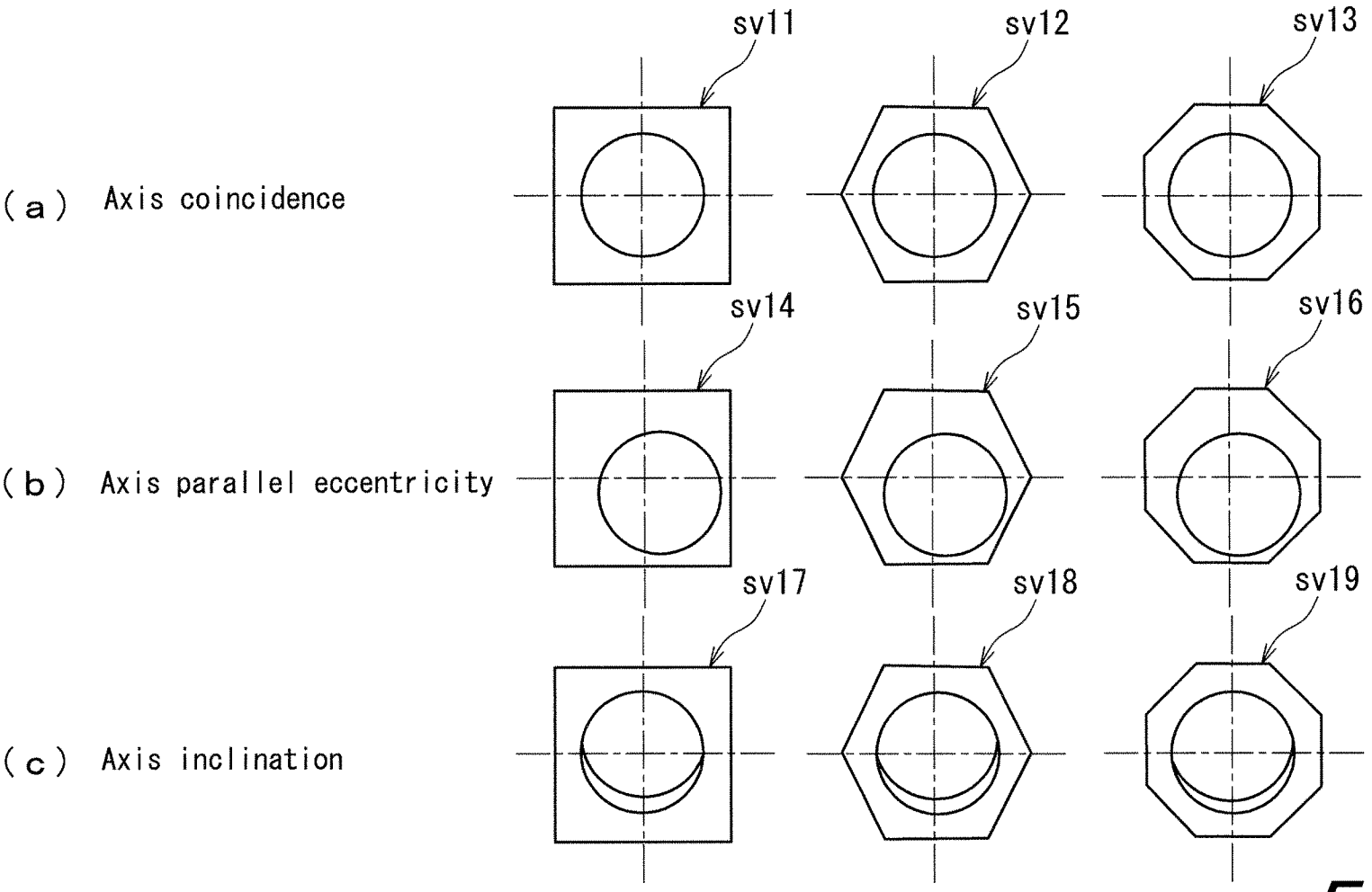
FIG. 21 is a plan view showing nine sleeves.

Each of nine drawings shown in FIG. 21 is a plan view (drawing viewed from the top) of the sleeve which can be applied to the present embodiment. In FIG. 21, examples of the sectional shape of the outer surface of the sleeve include a tetragon (square), a hexagon (regular hexagon), and an octagon (regular octagon). Axis coincidence, axis parallel eccentricity, and axis inclination are shown as the form of the axis displacement of the sleeve in FIG. 21.

In a sleeve sv11, the sectional shape of the outer surface of the sleeve is tetragon (square); the outer surface of the sleeve is a four-sided pyramid surface; and the axis line of the inner surface of the sleeve (the axis line of the shaft) coincides with the axis line of the outer surface of the sleeve. In a sleeve sv12, the sectional shape of the outer surface of the sleeve is a hexagon (regular hexagon); the outer surface of the sleeve is a six-sided pyramid surface; and the axis line of the inner surface of the sleeve (the axis line of the shaft) coincides with the axis line of the outer surface of the sleeve. In a sleeve sv13, the sectional shape of the outer surface of the sleeve is an octagon (regular octagon); the outer surface of the sleeve is a eight-sided pyramid surface; and the axis line of the inner surface of the sleeve (the axis line of the shaft) coincides with the axis line of the outer surface of the sleeve.

In a sleeve sv14, the sectional shape of the outer surface of the sleeve is a tetragon (square); the outer surface of the sleeve is a four-sided pyramid surface; and the axis line of the inner surface of the sleeve (the axis line of the shaft) is parallel and eccentric to the axis line of the outer surface of the sleeve. In a sleeve sv15, the sectional shape of the outer surface of the sleeve is a hexagon (regular hexagon); the outer surface of the sleeve is a six-sided pyramid surface; and the axis line of the inner surface of the sleeve (the axis line of the shaft) is parallel and eccentric to the axis line of the outer surface of the sleeve. In a sleeve sv16, the sectional shape of the outer surface of the sleeve is an octagon (regular octagon); the outer surface of the sleeve is a eight-sided pyramid surface; and the axis line of the inner surface of the sleeve (the axis line of the shaft) is parallel and eccentric to the axis line of the outer surface of the sleeve.

In a sleeve sv17, the sectional shape of the outer surface of the sleeve is a tetragon (square); the outer surface of the sleeve is a four-sided pyramid surface; and the axis line of the inner surface of the sleeve (the axis line of the shaft) is inclined with respect to the axis line of the outer surface of the sleeve. In a sleeve sv18, the sectional shape of the outer surface of the sleeve is a hexagon (regular hexagon); the outer surface of the sleeve is a six-sided pyramid surface; and the axis line of the inner surface of the sleeve (the axis line of the shaft) is inclined with respect to the axis line of the outer surface of the sleeve. In a sleeve sv19, the sectional shape of the outer surface of the sleeve is an octagon (regular octagon); the outer surface of the sleeve is a eight-sided pyramid surface; and the axis line of the inner surface of the sleeve (the axis line of the shaft) is inclined with respect to the axis line of the outer surface of the sleeve.

Thus, various sleeves may be used. Of course, these sleeves shown in FIG. 21 are merely exemplified. Similarly, various forms may be used also for the spacer.

From the viewpoint of preventing an excessively large hosel, the amount of eccentricity of parallel eccentricity in the sleeve is preferably equal to or less than 5 mm, more preferably equal to or less than 2 mm, and still more preferably equal to or less than 1.5 mm. From the viewpoint of adjusting properties, the amount of eccentricity of parallel eccentricity in the sleeve is preferably equal to or greater than 0.5 mm, and more preferably equal to or greater than 1.0 mm.

From the viewpoint of preventing an excessively large hosel, the inclination angle θ1 of the axis line of the shaft with respect to the axis line of the outer surface of the sleeve is preferably equal to or less than 5 degrees, more preferably equal to or less than 3 degrees, and still more preferably equal to or less than 2 degrees. From the viewpoint of adjusting properties, the inclination angle θ1 is preferably equal to or greater than 0.5 degrees, more preferably equal to or greater than 1 degree, and still more preferably equal to or greater than 1.5 degrees.

From the viewpoint of preventing an excessively large hosel, the amount of eccentricity of parallel eccentricity in the spacer is preferably equal to or less than 5 mm, more preferably equal to or less than 2 mm, and still more preferably equal to or less than 1.5 mm. From the viewpoint of adjusting properties, the amount of eccentricity of parallel eccentricity in the spacer is preferably equal to or greater than 0.5 mm, and more preferably equal to or greater than 1.0 mm.

From the viewpoint of preventing an excessively large hosel, the inclination angle θ2 of the axis line of the inner surface of the spacer with respect to the axis line of the outer surface of the spacer is preferably equal to or less than 5 degrees, more preferably equal to or less than 3 degrees, and still more preferably equal to or less than 2 degrees. From the viewpoint of adjusting properties, the angle θ2 is preferably equal to or greater than 0.5 degrees, more preferably equal to or greater than 1 degree, and still more preferably equal to or greater than 1.5 degrees.

A usual golf club has a ferrule. However, in the golf club according to the present embodiment, the ferrule may become an obstacle when the engaging part and the oppositely tapered hole are fitted into each other. The ferrule may become an obstacle also when the spacer is moved on the shaft. Therefore, the golf club preferably has no ferrule. From the viewpoint of obtaining an appearance close to the appearance of the ferrule, the upper end part of the sleeve is preferably exposed above the hosel end face in the engagement state. When the golf club has the spacer, the upper end part of the sleeve and the upper end part of the spacer are preferably exposed above the hosel end face in the engagement state. In this case, the upper end of the sleeve is more preferably above the upper end of the spacer. These exposed portions can exhibit the appearance close to the appearance of the ferrule.

Figure 22:
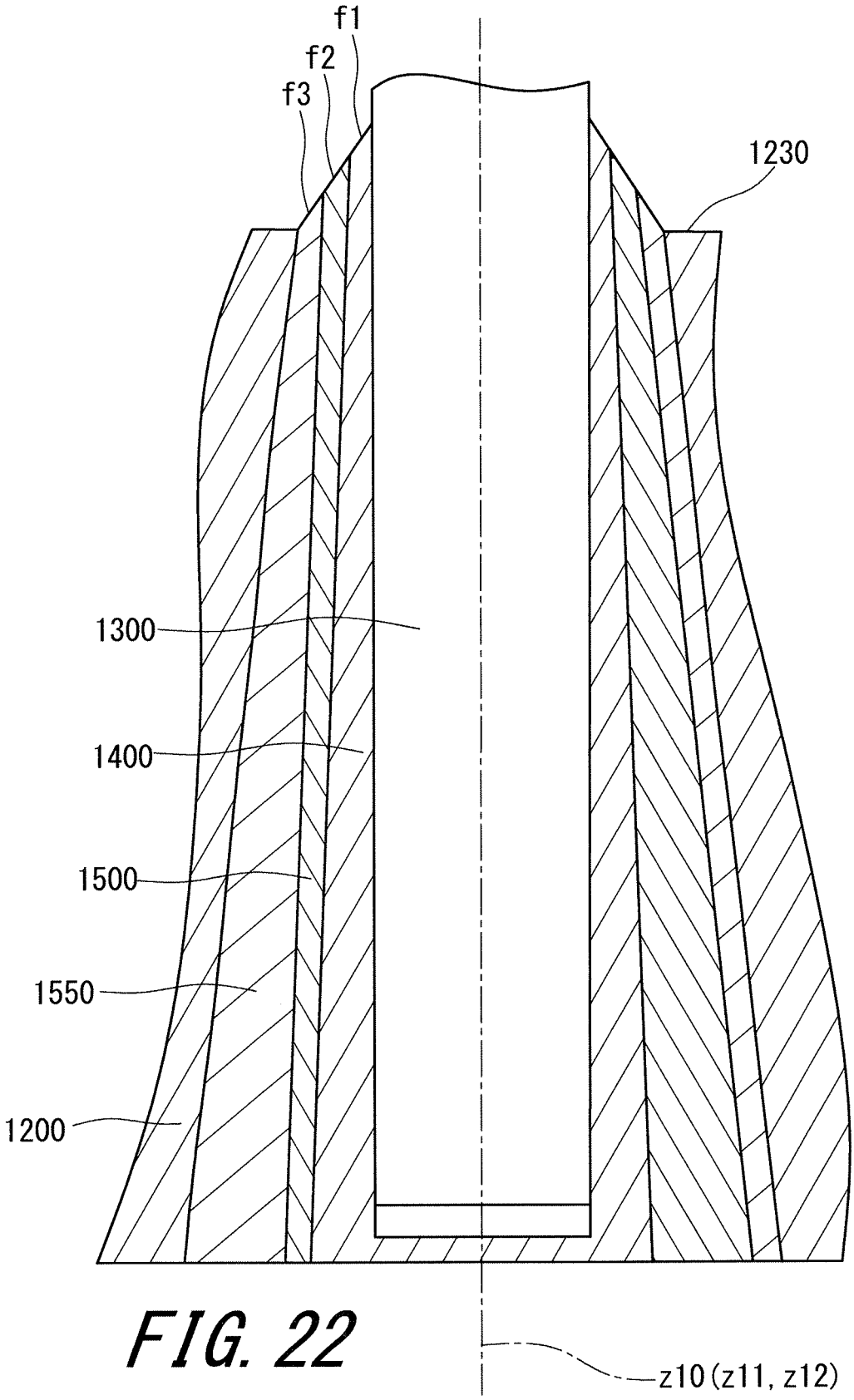
FIG. 22 is a sectional view of a head according to modification example.

FIG. 22 is a sectional view showing modification example of the head according to FIG. 10. The difference between the modification example of FIG. 22 and the embodiment of FIG. 10 lies in the shapes of the upper end faces of the sleeve 1400, the first spacer 1500, and the second spacer 1550.

In the embodiment of FIG. 10, an upper end face f1 of the sleeve 1400 is located above an upper end face f2 of the spacer 1500. Furthermore, the upper end face f2 of the first spacer 1500 is located above an upper end face f3 of the second spacer 1550. The upper end parts of the sleeve 1400 and the spacers 1500 and 1550 are located above a hosel end face 1230, and exposed to the outside. Each of the upper end face f1, the upper end face f2, and the upper end face f3 is a plane perpendicular to the axis line Z12 of the shaft. As a result, a circular stepway part located on the upper side as approaching the axis line Z12 of the shaft is formed above the hosel end face 1230. The circular stepway part exhibits the appearance close to the appearance of the ferrule.

In the embodiment of FIG. 22, the upper end face f1 of the sleeve 1400 is located above the upper end face f2 of the spacer 1500. Furthermore, the upper end face f2 of the first spacer 1500 is located above the upper end face f3 of the second spacer 1550. The upper end parts of the sleeve 1400 and the spacers 1500 and 1550 are located above the hosel end face 1230, and exposed to the outside. The upper end face f1 is a circular cone convex surface. The upper end face f2 is a circular cone convex surface. The upper end face f3 is a circular cone convex surface. The circular cone convex surfaces are inclined so that they are located on the upper side as approaching the axis line Z12 of the shaft. In addition, the upper end face f1, the upper end face f2, and the upper end face f3 continue so as to form a single circular cone convex surface. As a result, the single circular cone convex surface is formed above the hosel end face 1230. The circular cone convex surface exhibits the appearance close to the appearance of the ferrule.

The sectional area of the oppositely tapered hole of the hosel hole is gradually increased as going to the lower side (sole side). In other words, the area of sectional view of the oppositely tapered hole is gradually increased as going to the tip side of the shaft. The sectional shape of the oppositely tapered hole is a non-circle. The sectional shape of the non-circle prevents relative rotation between the hosel hole and the engaging part. The non-circle includes all shapes other than a circle. For example, the non-circle may be a shape having a projection, a recess, or a flat part at at least one place in the circumferential direction of the circle. Preferably, the sectional shape of the oppositely tapered hole is a polygon. Examples of the polygon include a triangle, a tetragon, a pentagon, a hexagon, a heptagon, an octagon, and a dodecagon. The polygon is preferably an N-sided polygon (N is an even number), and examples of the N-sided polygon include the tetragon, the hexagon, the octagon, and the dodecagon. From the viewpoint of anti-rotation, the tetragon, the hexagon, and the octagon are preferable. The sectional shape of the oppositely tapered hole is more preferably a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon (N is an even number), and examples of the regular N-sided polygon include the regular tetragon (square), the regular hexagon, the regular octagon, and the regular dodecagon. From the viewpoint of anti-rotation, the regular tetragon, the regular hexagon, and the regular octagon are more preferable.

The oppositely tapered hole preferably includes a plurality of surfaces. Each of the surfaces may be a plane, or may be a curved surface. From the viewpoint of ensuring surface contact with the engaging part, each of these surfaces is preferably a plane. From the viewpoint of ensuring surface contact with the engaging part, the oppositely tapered hole preferably includes a pyramid surface. The pyramid surface is apart of an outer surface of a pyramid. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface (N is an even number), and examples of the N-sided pyramid surface include the four-sided pyramid surface, the six-sided pyramid surface, the eight-sided pyramid surface, and the twelve-sided pyramid surface. From the viewpoint of anti-rotation, the four-sided pyramid surface, the six-sided pyramid surface, and the eight-sided pyramid surface are more preferable.

As described above, the club of the present embodiment has the sleeve. The inner surface of the sleeve (shaft hole) has the same shape as the shape of the tip part of the shaft inserted into the sleeve. Usually, the sectional shape of the shaft hole is a circle. Typically, the inner surface of the sleeve (shaft hole) and the outer surface of the shaft are bonded by an adhesive.

The area of a figure including a sectional line of the outer surface of the sleeve as an outer edge is larger as going to a lower side (sole side). In other words, the area of sectional view of the outer surface of the sleeve is gradually increased as going to the tip side of the shaft. The sectional shape of the outer surface of the sleeve is a non-circle. The sectional shape of the non-circle prevents relative rotation between the sleeve and an abutting portion. The abutting portion is the inner surface of the spacer or the oppositely tapered hole. When a plurality of spacers are present, the abutting portion is the inner surface of the innermost spacer. The non-circle includes all shapes other than a circle. For example, the non-circle may be a shape having a projection, a recess, or a flat part at at least one place in the circumferential direction of the circle. Preferably, the sectional shape of the outer surface of the sleeve is a polygon. Examples of the polygon include a triangle, a tetragon, a pentagon, a hexagon, a heptagon, an octagon, and a dodecagon. The polygon is preferably an N-sided polygon (N is an even number), and examples of the N-sided polygon include the tetragon, the hexagon, the octagon, and the dodecagon. From the viewpoint of anti-rotation, the tetragon, the hexagon, and the octagon are preferable. The sectional shape of the outer surface of the sleeve is more preferably a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon (N is an even number), and examples of the regular N-sided polygon include the regular tetragon (square), the regular hexagon, the regular octagon, and the regular dodecagon. From the viewpoint of anti-rotation, the regular tetragon, the regular hexagon, and the regular octagon are more preferable.

The outer surface of the sleeve preferably includes a plurality of surfaces. Each of the surfaces may be a plane, or may be a curved surface. From the viewpoint of ensuring surface contact with the abutting portion, each of these surfaces is preferably a plane. From the viewpoint of ensuring surface contact with the abutting portion, the outer surface of the sleeve is preferably a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface (N is an even number), and examples of the N-sided pyramid surface include the four-sided pyramid surface, the six-sided pyramid surface, the eight-sided pyramid surface, and the twelve-sided pyramid surface. From the viewpoint of anti-rotation, the four-sided pyramid surface, the six-sided pyramid surface, and the eight-sided pyramid surface are more preferable.

As described above, the club of the present embodiment may have one or more spacers. The inner surface of the spacer has the same shape as the shape of an outer surface of a member (inner member) internally fitted into the spacer. The inner member is the sleeve or the other spacer.

The area of a figure including a sectional line of the inner surface of the spacer as an outer edge is gradually increased as going to a lower side (sole side). In other words, the area of sectional view of the inner surface of the spacer is gradually increased as going to the tip side of the shaft. The sectional shape of the inner surface of the spacer is a non-circle. The sectional shape of the non-circle prevents relative rotation between the spacer and the inner member. When a plurality of spacers are present, the inner member is the other spacer. The non-circle includes all shapes other than a circle. For example, the non-circle may be a shape having a projection, a recess, or a flat part at at least one place in the circumferential direction of the circle. Preferably, the sectional shape of the inner surface of the spacer is a polygon. Examples of the polygon include a triangle, a tetragon, a pentagon, a hexagon, a heptagon, an octagon, and a dodecagon. The polygon is preferably an N-sided polygon (N is an even number), and examples of the N-sided polygon include the tetragon, the hexagon, the octagon, and the dodecagon. From the viewpoint of anti-rotation, the tetragon, the hexagon, and the octagon are preferable. The sectional shape of the inner surface of the spacer is more preferably a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon (N is an even number), and examples of the regular N-sided polygon include the regular tetragon (square), the regular hexagon, the regular octagon, and the regular dodecagon. From the viewpoint of anti-rotation, the regular tetragon, the regular hexagon, and the regular octagon are more preferable.

The inner surface of the spacer preferably includes a plurality of surfaces. Each of the surfaces may be a plane, or may be a curved surface. From the viewpoint of ensuring surface contact with the inner member, each of these surfaces is preferably a plane. From the viewpoint of ensuring surface contact with the inner member, the inner surface of the spacer is preferably a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface (N is an even number), and examples of the N-sided pyramid surface include the four-sided pyramid surface, the six-sided pyramid surface, the eight-sided pyramid surface, and the twelve-sided pyramid surface. From the viewpoint of anti-rotation, the four-sided pyramid surface, the six-sided pyramid surface, and the eight-sided pyramid surface are more preferable.

As described above, the club of the present embodiment has the engaging part. The engaging part may include only the sleeve, or may include the sleeve and one or more spacers. When the spacer is not used, the outer surface of the engaging part is the outer surface of the sleeve. When one spacer is used, the outer surface of the engaging part is the outer surface of the spacer. When two or more spacers are used, the outer surface of the engaging part is the outer surface of the outermost spacer.

The area of a figure including a sectional line of the outer surface of the engaging part as an outer edge is gradually increased as going to a lower side (sole side). In other words, the area of sectional view of the outer surface of the engaging part is gradually increased as going to the tip side of the shaft. The sectional shape of the outer surface of the engaging part is a non-circle. The sectional shape of the non-circle prevents relative rotation between the engaging part and the oppositely tapered hole. The non-circle includes all shapes other than a circle. For example, the non-circle may be a shape having a projection, a recess, or a flat part at at least one place in the circumferential direction of the circle. Preferably, the sectional shape of the outer surface of the engaging part is a polygon. Examples of the polygon include a triangle, a tetragon, a pentagon, a hexagon, a heptagon, an octagon, and a dodecagon. The polygon is preferably an N-sided polygon (N is an even number), and examples of the N-sided polygon include the tetragon, the hexagon, the octagon, and the dodecagon. From the viewpoint of anti-rotation, the tetragon, the hexagon, and the octagon are preferable. The sectional shape of the outer surface of the engaging part is more preferably a regular polygon. Preferable examples of the regular polygon include a regular triangle, a regular tetragon (square), a regular pentagon, a regular hexagon, a regular heptagon, a regular octagon, and a regular dodecagon. The regular polygon is more preferably a regular N-sided polygon (N is an even number), and examples of the regular N-sided polygon include the regular tetragon (square), the regular hexagon, the regular octagon, and the regular dodecagon. From the viewpoint of anti-rotation, the regular tetragon, the regular hexagon, and the regular octagon are more preferable.

The outer surface of the engaging part preferably includes a plurality of surfaces. Each of the surfaces may be a plane, or may be a curved surface. From the viewpoint of ensuring surface contact with the engaging part, each of these surfaces is preferably a plane. From the viewpoint of ensuring surface contact with the engaging part, the outer surface of the engaging part is preferably a pyramid surface. Examples of the pyramid surface include a three-sided pyramid surface, a four-sided pyramid surface, a five-sided pyramid surface, a six-sided pyramid surface, a seven-sided pyramid surface, an eight-sided pyramid surface, and a twelve-sided pyramid surface. The pyramid surface is more preferably an N-sided pyramid surface (N is an even number), and examples of the N-sided pyramid surface include the four-sided pyramid surface, the six-sided pyramid surface, the eight-sided pyramid surface, and the twelve-sided pyramid surface. From the viewpoint of anti-rotation, the four-sided pyramid surface, the six-sided pyramid surface, and the eight-sided pyramid surface are more preferable.

Each of the above-mentioned Ns is preferably an integer of equal to or greater than or 3.

Thus, the oppositely tapered fitting is formed by the sleeve and the oppositely tapered hole while the spacer is interposed if needed. By the force in the engaging releasing direction, the oppositely tapered fitting is easily released. In addition, the oppositely tapered fitting is easily formed by the force in the engaging direction. The shaft is easily attached to, and detached from the head. When the shaft is attached and detached, work for turning a screw is eliminated. The loss of the screw is also of no matter.

From the viewpoint of the Golf Rules, it is preferable that the coming-off preventing mechanism cannot be released by bare hands. The constitution is achieved by increasing the spring constants of the leaf spring 226 and the compression spring 234 in the coming-off preventing mechanism, for example. From the viewpoint of the Golf Rules, it is preferable that a special tool is required for the coming-off preventing mechanism.

The material of the sleeve is not limited. Preferable examples of the material include a titanium alloy, stainless steel, an aluminum alloy, a magnesium alloy, and a resin. From the viewpoint of strength and lightweight properties, for example, the aluminum alloy and the titanium alloy are more preferable. It is preferable that the resin has excellent mechanical strength. For example, the resin is preferably a resin referred to as an engineering plastic or a super-engineering plastic.

The material of the spacer is not limited. Preferable examples of the material include a titanium alloy, stainless steel, an aluminum alloy, a magnesium alloy, and a resin. From the viewpoint of strength and lightweight properties, for example, the aluminum alloy and the titanium alloy are more preferable. It is preferable that the resin has excellent mechanical strength. For example, the resin is preferably a resin referred to as an engineering plastic or a super-engineering plastic. From the viewpoint of moldability, the resin is preferable.

As described above, the golf club of the embodiment has an adjusting mechanism capable of adjusting the position and/or the angle of the axis line of the shaft. The adjusting mechanism preferably satisfies the Golf Rules defined by R&A (The Royal and Ancient Golf Club of St Andrews). That is, the adjusting mechanism preferably satisfies requirements specified in "1b Adjustability" in "1. Clubs" of "Appendix II Design of Clubs" defined by R&A. The requirements specified in the "1b Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform with the Rules.

EXAMPLES

Hereinafter, the effects of the present embodiment will be clarified by Examples. However, the present embodiment should not be interpreted in a limited way based on the description of the Examples.

The same golf club as the above-mentioned golf club 100 was produced as Examples.

A head made of a titanium alloy was obtained by a known method. An oppositely tapered hole was formed by casting, and then finished to a predetermined size by NC process. A sleeve was made of an aluminum alloy. A process for manufacturing the sleeve was NC process. A spacer was made of an aluminum alloy. A process for manufacturing the spacer was NC process. A known carbon shaft was used as a shaft. The shaft was made to pass through the spacer, and the sleeve was then fixed to a tip part of the shaft by an adhesive, to obtain a shaft assembly.

According to the procedure described in FIG. 4, the shaft assembly was mounted to the head to obtain a golf club in an engagement state. The engagement state was maintained by a coming-off preventing mechanism. When a ball was actually hit by the golf club, retention and anti-rotation functioned completely, to obtain the same hitting as the hitting of a usual golf club. By pressing a leaf spring of the coming-off preventing mechanism, the engagement state was easily released, and thereby the shaft assembly could be separated from the head. In the shaft assembly, the spacer fitted into the sleeve was moved to a grip side, rotated, and fitted into the sleeve again. According to the process, the rotation position of the spacer with respect to the rotation position of the sleeve could be changed. When an engaging part of the shaft assembly was fitted into the oppositely tapered hole, the rotation position of the engaging part could be selected. As described in FIGS. 15 to 18, nine shaft positions were enabled in the club.

The embodiment described above can be applied to all golf clubs such as a wood type golf club, a hybrid type golf club, an iron type golf club, and a putter type golf club.

The above description is merely illustrative example, and various modifications can be made in the scope not to depart from the principal of the present embodiment.

What is claimed is:

1. A golf club comprising:

a head having a hosel part;

a shaft; and an engaging part disposed at a tip part of the shaft, wherein:

the engaging part includes a sleeve which has an oppositely tapered shape and is fixed to the tip part of the shaft;

the hosel part includes a hosel hole, and a hosel slit which is provided on a side of the hosel hole and enables the shaft to pass through the hosel slit;

the hosel hole has an oppositely tapered hole having a shape corresponding to a shape of an outer surface of the engaging part; and the engaging part is fitted into the oppositely tapered hole.

2. The golf club according to claim 1, wherein an axis line of the shaft is inclined with respect to, or parallel and eccentric to an axis line of an outer surface of the sleeve.

3. The golf club according to claim 1, wherein the engaging part includes the sleeve and at least one spacer externally fitted to the sleeve.

4. The golf club according to claim 3, wherein an axis line of an inner surface of the spacer is inclined with respect to, or parallel and eccentric to an axis line of an outer surface of the spacer.

5. The golf club according to claim 1, wherein the outer surface of the engaging part is a pyramid surface.

6. The golf club according to claim 5, wherein the pyramid surface is a four-sided pyramid surface, a six-sided pyramid surface, or an eight-sided pyramid surface.

7. The golf club according to claim 1, wherein the head further includes a coming-off preventing mechanism for regulating a movement of the engaging part in an engaging releasing direction.

8. The golf club according to claim 1, wherein an area of sectional view of an outer surface of the sleeve is gradually increased as going to a tip side of the shaft, and an area of sectional view of the outer surface of the engaging part is gradually increased as going to the tip side of the shaft.

9. The golf club according to claim 8, wherein an area of sectional view of the oppositely tapered hole is gradually increased as going to the tip side of the shaft.

* * * * *